US011644035B1

(12) United States Patent
Park et al.

(10) Patent No.: US 11,644,035 B1
(45) Date of Patent: May 9, 2023

(54) VANE ROTARY COMPRESSOR

(71) Applicant: LG ELECTRONICS INC., Seoul (KR)

(72) Inventors: Joonhong Park, Seoul (KR); Seoungmin Kang, Seoul (KR); Jinung Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/881,883

(22) Filed: Aug. 5, 2022

(30) Foreign Application Priority Data

Oct. 28, 2021 (KR) ..... 10-2021-0145796

(51) Int. Cl.

| | |
|---|---|
| ***F04C 18/34*** | (2006.01) |
| ***F04C 2/32*** | (2006.01) |
| ***F04C 29/12*** | (2006.01) |
| ***F04C 18/344*** | (2006.01) |
| ***F04C 2/344*** | (2006.01) |
| *F04C 23/00* | (2006.01) |

(52) U.S. Cl.
CPC ..... *F04C 18/3445* (2013.01); *F04C 2/321* (2013.01); *F04C 2/344* (2013.01); *F04C 18/3442* (2013.01); *F04C 29/124* (2013.01); *F04C 23/008* (2013.01); *F04C 2210/26* (2013.01); *F04C 2240/50* (2013.01)

(58) Field of Classification Search
CPC ..... F04C 18/3445; F04C 18/344; F04C 18/3442; F04C 29/124; F04C 2/321; F04C 2/344
See application file for complete search history.

(56) References Cited

U.S. PATENT DOCUMENTS

2009/0162234 A1 6/2009 Shimaguchi et al.
2014/0112817 A1* 4/2014 Osaki ..... F04C 18/344 418/266

FOREIGN PATENT DOCUMENTS

| | | |
|---|---|---|
| CN | 105402125 | 3/2016 |
| DE | 20 2015 005 274 | 9/2015 |
| JP | 62-267589 | 11/1987 |
| JP | 2013-213438 | 10/2013 |
| JP | 2013-540938 | 11/2013 |
| JP | 5890292 | 3/2016 |

(Continued)

OTHER PUBLICATIONS

English translation of WO-2016084874 by PE2E Nov. 11, 2022.*

(Continued)

*Primary Examiner* — Deming Wan
(74) *Attorney, Agent, or Firm* — Ked & Associates

(57) ABSTRACT

A rotary compressor may include a casing, a cylinder, a main bearing, a sub bearing, a rotational shaft, a roller having at least one vane slot and a back pressure chamber, and at least one vane. The roller may include at least one spring insertion groove formed in an inner end portion of the at least one vane slot in a lengthwise direction of the at least one vane slot, and a vane spring that supports a rear surface of the vane toward an inner circumferential surface of the cylinder may be disposed in the at least one spring insertion groove. Accordingly, elastic force may be supplied to the rear surface of the vane, to suppress or prevent trembling of the vane caused while the vane passes through a proximal portion during operation.

20 Claims, 21 Drawing Sheets

(56) References Cited

FOREIGN PATENT DOCUMENTS

| | | | | | |
|---|---|---|---|---|---|
| JP | 2016148350 | A | * | 8/2016 | ..... C21D 1/06 |
| KR | 10-0385683 | | | 5/2003 | |
| KR | 10-2013-0116709 | | | 10/2013 | |
| KR | 10-2020-0057542 | | | 5/2020 | |
| WO | WO-2016084874 | A1 | * | 6/2016 | ..... F04C 18/344 |
| WO | WO 2018/215260 | | | 11/2018 | |

OTHER PUBLICATIONS

English translation of JP 2016/148350 by PE2E Nov. 11, 2022.*
Korean Office Action issued in Application No. 10-2021-0145796 dated Oct. 13, 2022.
European Search Report issued in Application No. 22187774.9 dated Feb. 13, 2023.

* cited by examiner

VANE ROTARY COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2021-0145796, filed in Korea on Oct. 28, 2021, the contents of which are incorporated by reference herein in their entirety.

BACKGROUND

1. Field

A vane rotary compressor is disclosed herein.

2. Background

A rotary compressor can be divided into two types, namely, a type in which a vane is slidably inserted into a cylinder to come in contact with a roller, and another type in which a vane is slidably inserted into a roller to come in contact with a cylinder. In general, the former is called a roller eccentric rotary compressor (hereinafter referred to as a "rotary compressor"), and the latter is referred to as a vane concentric rotary compressor (hereinafter, a "vane rotary compressor").

As for a rotary compressor, a vane inserted into a cylinder is pulled out toward a roller by elastic force or back pressure to come into contact with an outer circumferential surface of the roller. On the other hand, for a vane rotary compressor, a vane inserted in a roller rotates together with the roller, and is pulled out by centrifugal force and back pressure to come into contact with an inner circumferential surface of a cylinder.

A rotary compressor independently forms as many compression chambers as the number of vanes per revolution of a roller, and the compression chambers simultaneously perform suction, compression, and discharge strokes. On the other hand, a vane rotary compressor continuously forms as many compression chambers as the number of vanes per revolution of a roller, and the compression chambers sequentially perform suction, compression, and discharge strokes. Accordingly, the vane rotary compressor has a higher compression ratio than the rotary compressor. Therefore, the vane rotary compressor is more suitable for high pressure refrigerants such as R32, R410a, and $CO_2$, which have low ozone depletion potential (ODP) and global warming index (GWP).

Such a vane rotary compressor is disclosed in Japanese Laid-Open Patent Application No. JP2013-213438A (hereinafter "Patent Document 1"), which is hereby incorporated by reference. The vane rotary compressor disclosed in Patent Document 1 is a low-pressure type in which suction refrigerant is filled in an inner space of a motor room but discloses a structure in which a plurality of vanes is slidably inserted into a rotating roller.

In Patent Document 1, a back pressure chamber is disposed at a rear end portion of each vane to communicate with a back pressure pocket. The back pressure pocket is divided into a first pocket forming intermediate pressure and a second pocket forming discharge pressure or intermediate pressure close to the discharge pressure. The first pocket communicates with the back pressure chamber located at an upstream side and the second pocket communicates with the back pressure chamber located at a downstream side, with respect to a direction from a suction side to a discharge side.

However, in the related art vane rotary compressor, shaking or trembling which is caused when the vane is spaced apart from the cylinder and then brought into contact with the cylinder due to a pressure difference between front and rear surfaces during operation may occur. In particular, this phenomenon may be severe at the beginning of operating the compressor, which causes a start operation failure, thereby lowering efficiency of the compressor and delaying cooling and heating effects when applied to an air conditioner.

In addition, in the related art vane rotary compressor, the trembling of the vane intensively occurs around a contact point, and thereby an inner circumferential surface of the cylinder or the front surface of the vane may be worn around the contact point. This may cause not only an increase in vibration noise at a specific position, but also leakage between compression chambers due to communication between a compression chamber performing a suction stroke and another compression chamber performing a discharge stroke. Due to the leakage between the compression chambers, a specific volume of suction refrigerant may increase and an amount of suction refrigerant may decrease, which may cause suction loss, thereby reducing compressor efficiency.

In addition, in the related art vane rotary compressor, pressure pulsation may be caused by non-uniform pressure of oil supplied toward the rear surface of the vane. Accordingly, back pressure formed on the rear surface of the vane may become inconsistent, causing more severe trembling of the vane.

Those problems become more serious when a high-pressure refrigerant, such as R32, R410a, or $CO_2$ is used. In more detail, when the high-pressure refrigerant is used, a same level of cooling capability may be obtained as that obtained when using a relatively low-pressure refrigerant, such as R134a, even though the volume of each compression chamber is reduced by increasing the number of vanes. However, if the number of vanes increases, a frictional area between the vanes and the cylinder are increased accordingly. As a result, a bearing surface on a rotational shaft is reduced, which makes behavior of the rotational shaft more unstable, leading to a further increase in mechanical friction loss. This may be even worse under a low-temperature heating condition, a high pressure ratio condition ($Pd/Ps \geq 6$), and a high-speed operating condition (above 80 Hz).

BRIEF DESCRIPTION OF THE DRAWINGS

Embodiments will be described in detail with reference to the following drawings in which like reference numerals refer to like elements, and wherein:

FIG. 9A illustrates a remote portion region and FIG. 9B illustrates a proximal portion region;

FIG. 21A illustrates a remote portion region and FIG. 21B illustrates a proximal portion region.

DETAILED DESCRIPTION

Description will now be given of a vane rotary compressor according to embodiments disclosed herein, with reference to the accompanying drawings.

Embodiments describe a structure in which a vane spring is disposed in a roller, which may be equally applied to a vane rotary compressor in which a vane is slidably inserted into a roller. For example, the embodiments may be equally applicable not only to a vane rotary compressor having an elliptical (hereinafter, asymmetric elliptical) cylinder, an inner circumferential surface of which has a plurality of curvatures, but also to a vane rotary compressor having a circular cylinder, an inner circumferential surface of which has one curvature. The embodiments may also be equally applicable to a vane rotary compressor in which a vane slot into which a vane is slidably inserted is inclined by a predetermined angle with respect to a radial direction of a roller, as well as a vane rotary compressor in which a vane slot is formed in a radial direction of a roller. Hereinafter, an example in which an inner circumferential surface of a cylinder has an asymmetric elliptical shape and a vane slot is inclined with respect to a radial direction of a roller will be described as a representative example.

Figure 1:
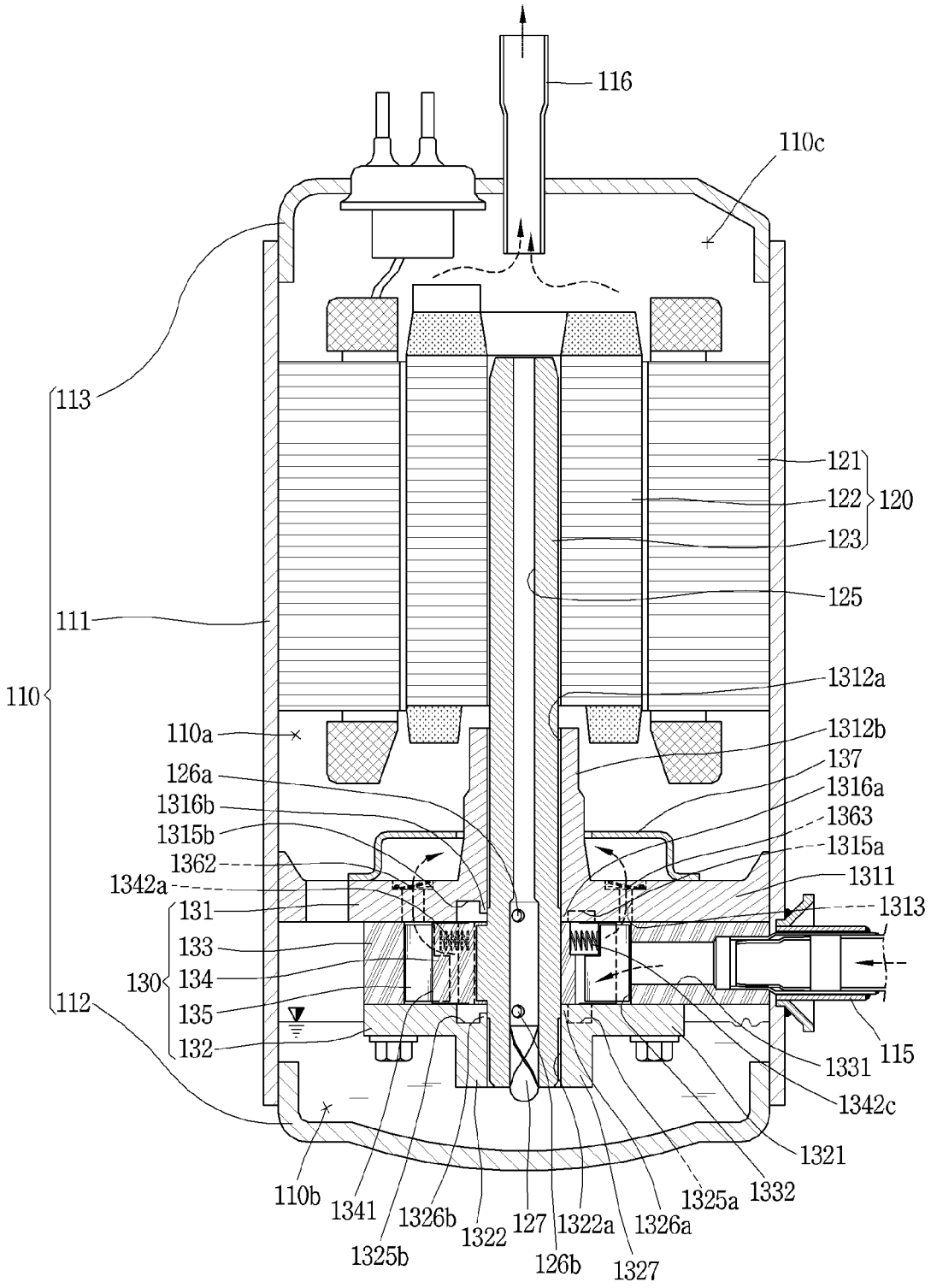
FIG. 1 is a cross-sectional view of a vane rotary compressor according to an embodiment.
Figure 2:
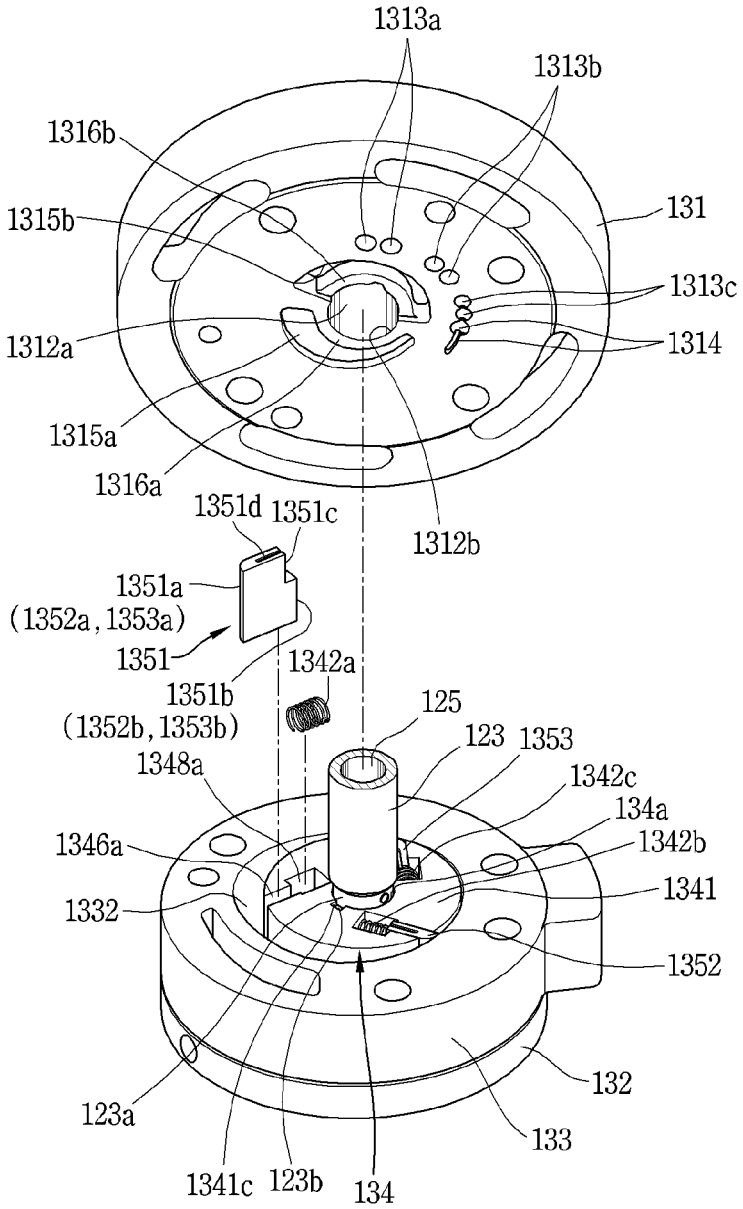
FIG. 2 is an exploded perspective view of a compression unit in FIG. 1.
Figure 3:
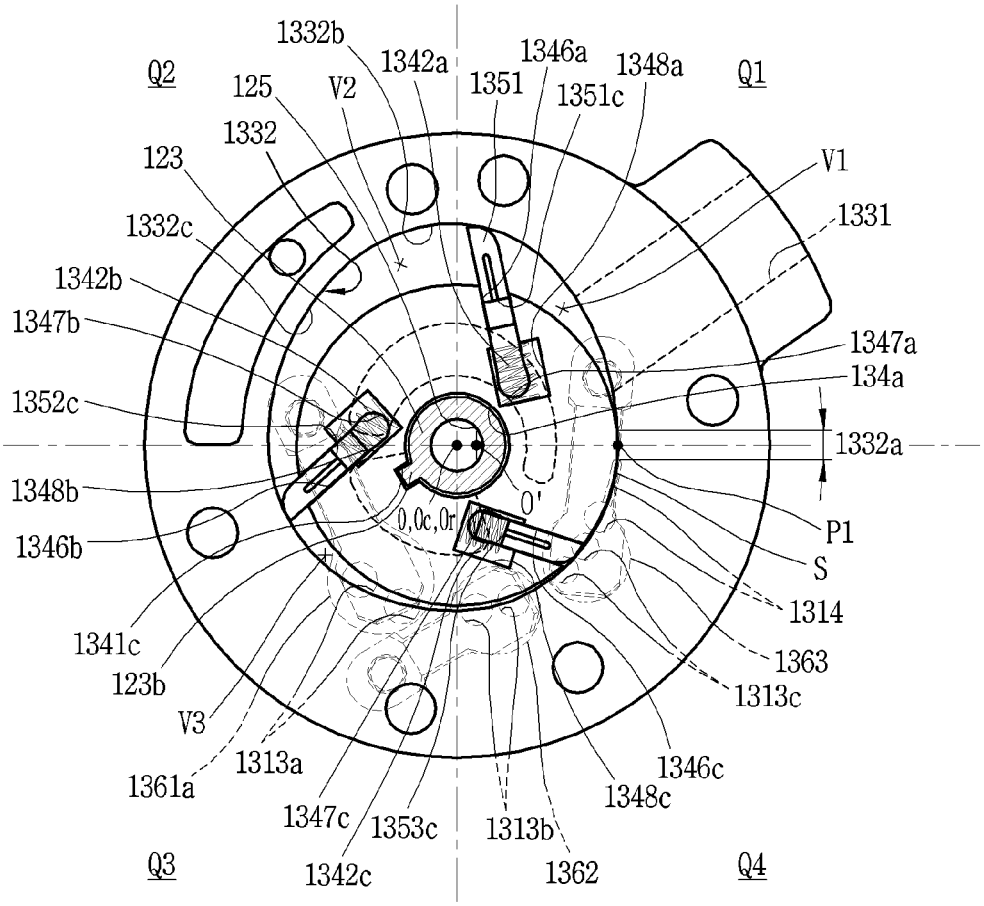
FIG. 3 is an assembled planar view of the compression unit in FIG. 2.

FIG. 1 is a cross-sectional view of a vane rotary compressor according to an embodiment. FIG. 2 is an exploded perspective view of a compression unit in FIG. 1, and FIG. 3 is an assembled planar view of the compression unit in FIG. 2.

Referring to FIG. 1, a vane rotary compressor according to this embodiment may include a casing 110, a drive motor 120, and a compression unit 130. The drive motor 120 may be installed in an upper inner space 110*a* of the casing 110, and the compression unit 130 may be installed in a lower inner space 110*a* of the casing 110. The drive motor 120 and the compression unit 130 may be connected through a rotational shaft 123.

The casing 110 that defines an outer appearance of the compressor may be classified as a vertical type and a horizontal type according to a compressor installation method. As for the vertical type casing, the drive motor 120 and the compression unit 130 may be disposed at upper and lower sides in an axial direction, respectively. As for the horizontal type casing, the drive motor 120 and the compression unit 130 may be disposed at left and right or lateral sides, respectively. The casing according to this embodiment may be illustrated as the vertical type.

The casing 110 may include an intermediate shell 111 having a cylindrical shape, a lower shell 112 that covers a lower end of the intermediate shell 111, and an upper shell 113 that covers an upper end of the intermediate shell 111. The drive motor 120 and the compression unit 130 may be inserted into the intermediate shell 111 to be fixed thereto, and a suction pipe 115 may penetrate through the intermediate shell 111 to be directly connected to the compression unit 130. The lower shell 112 may be coupled to a lower end of the intermediate shell 111 in a sealing manner, and an oil storage space 110*b* in which oil to be supplied to the compression unit 130 may be stored may be formed below the compression unit 130. The upper shell 113 may be coupled to an upper end of the intermediate shell 111 in a sealing manner, and an oil separation space 110*c* may be formed above the drive motor 120 to separate oil from refrigerant discharged from the compression unit 130.

The drive motor 120 that constitutes a motor unit supplies power to cause the compression unit 130 to be driven. The drive motor 120 may include a stator 121, a rotor 122, and the rotational shaft 123.

The stator 121 may be fixedly inserted into the casing 110. The stator 121 may be fixed to an inner circumferential surface of the casing 110 in, for example, a shrink-fitting manner. For example, the stator 121 may be, for example, press-fitted into the inner circumferential surface of the intermediate shell 111.

The rotor 122 may be rotatably inserted into the stator 121, and the rotational shaft 123 may be, for example, press-fitted into a center of the rotor 122. Accordingly, the rotational shaft 123 may rotate concentrically together with the rotor 122.

An oil flow path 125 having a hollow hole shape may be formed in a central portion of the rotational shaft 123, and oil passage holes 126*a* and 126*b* may be formed through a middle portion of the oil flow path 125 toward an outer circumferential surface of the rotational shaft 123. The oil passage holes 126*a* and 126*b* may include first oil passage hole 126*a* belonging to a range of a main bush portion 1312 described hereinafter and a second oil passage hole 126*b* belonging to a range of a sub bush portion 1322. Each of the first oil passage hole 126*a* and the second oil passage hole 126*b* may be provided by as one or a plurality. In this embodiment, each of the first and second oil passage holes is provided as a plurality.

An oil pickup 127 may be installed at a middle or lower end of the oil flow path 125. A gear pump, a viscous pump, or a centrifugal pump may be used for the oil pickup 127. This embodiment illustrates a case in which the centrifugal pump is employed. Accordingly, when the rotational shaft 123 rotates, oil filled in the oil storage space 110*b* is pumped by the oil pickup 127 and is suctioned along the oil flow path 125, so as to be introduced into a sub bearing surface 1322*b* of the sub bush portion 1322 through the second oil passage hole 126*b* and into a main bearing surface 1312*b* of the main bush portion 1312 through the first oil passage hole 126*a*.

The rotational shaft 123 may include a roller 134 described hereinafter. The roller 134 may extend integrally from the rotational shaft 123 or the rotational shaft 123 and the roller 134 may be separately manufactured and post-assembled to each other. In this embodiment, the rotational shaft 123 is post-assembled by being inserted into the roller 134. For example, a shaft hole 134*a* may be formed through a center of the roller 134 in an axial direction and the rotational shaft 123 may be inserted into the shaft hole 134*a*.

In this case, a rotation preventing key 123*b* may be formed on an outer circumferential surface of the rotational shaft 123, and a rotation preventing groove 1341*c* may be formed in an inner circumferential surface of the roller 134, that is, an inner circumferential surface of the shaft hole 134*a*. The rotation preventing key 123*b* may protrude in a radial direction, and the rotation preventing groove 1341*c* may be recessed in the radial direction so that the rotation preventing key 123*b* is inserted therein. Accordingly, the rotational shaft 123 and the roller 134 may be mutually constrained in a circumferential direction.

The rotation preventing key 123*b* and the rotation preventing groove 1341*c* may be provided as only one as illustrated in the drawings, and in some cases, may be provided as a plurality disposed at equal intervals along a circumferential direction. A coupling relationship between the rotational shaft 123 and the roller 134 will be described hereinafter together with the roller 134.

The compression unit 130 may include a main bearing 131, a sub bearing 132, a cylinder 133, a roller 134, and a plurality of vanes 1351, 1352, and 1353. The main bearing 131 and the sub bearing 132 may be respectively provided at upper and lower portions of the cylinder 133 to define a compression space V together with the cylinder 133, the roller 134 may be rotatably installed in the compression space V, and the vanes 1351, 1352, and 1353 may be slidably inserted into the roller 134 to divide the compression space V into a plurality of compression chambers.

Referring to FIGS. 1 to 3, the main bearing 131 may be fixedly installed in the intermediate shell 111 of the casing 110. For example, the main bearing 131 may be inserted into the intermediate shell 111 and welded thereto.

The main bearing 131 may be coupled to an upper end of the cylinder 133 in a close contact manner. Accordingly, the main bearing 131 may define an upper surface of the compression space V, and support an upper surface of the roller 134 in the axial direction and at the same time support an upper portion of the rotational shaft 123 in the radial direction.

The main bearing 131 may include a main plate portion 1311 and a main bush portion 1322. The main plate portion 1311 may cover an upper portion of the cylinder 133 to be coupled thereto, and the main bush portion 1312 may axially extend from a center of the main plate portion 1311 toward the drive motor 120 so as to support the upper portion of the rotational shaft 123.

The main plate portion 1311 may have a disk shape, for example, and an outer circumferential surface of the main plate portion 1311 may be fixed to the inner circumferential surface of the intermediate shell 111 in a close contact manner. One or more discharge ports 1313*a*, 1313*b*, and 1313*c* may be formed in the main plate portion 1311, and a plurality of discharge valves 1361, 1362, and 1363 configured to open and close the respective discharge ports 1313*a*, 1313*b*, and 1313*c* may be installed on an upper surface of the main plate portion 1311. A discharge muffler 137 having a discharge space (no reference numeral) may be provided at an upper portion of the main plate portion 1311 to accommodate the discharge ports 1313*a*, 1313*b*, and 1313*c*, and the discharge valves 1361, 1362, and 1363. The discharge ports will be described hereinafter.

A first main back pressure pocket 1315*a* and a second main back pressure pocket 1315*b* may be formed in a lower surface, namely, a main sliding surface 1311*a* of the main plate portion 1311 facing the upper surface of the roller 134, of both axial side surfaces of the main plate portion 1311. The first main back pressure pocket 1315*a* and the second main back pressure pocket 1315*b* each having an arcuate shape may be disposed at a predetermined interval in the circumferential direction. Each of the first main back pressure pocket 1315*a* and the second main back pressure pocket 1315*b* may have an inner circumferential surface with a circular shape, but may have an outer circumferential surface with an oval or elliptical shape in consideration of vane slots described hereinafter.

The first main back pressure pocket 1315*a* and the second main back pressure pocket 1315*b* may be formed within an outer diameter range of the roller 134. Accordingly, the first main back pressure pocket 1315*a* and the second main back pressure pocket 1315*b* may be separated from the compression space V. However, the first main back pressure pocket 1315*a* and the second main back pressure pocket 1315*b* may slightly communicate with each other through a gap between a lower surface, a main sliding surface 1311*a* of the main plate portion 1311 and the upper surface of the roller 134 facing each other unless a separate sealing member is provided therebetween.

The first main back pressure pocket 1315*a* forms a pressure lower than a pressure formed in the second main back pressure pocket 1315*b*, for example, an intermediate pressure between a suction pressure and a discharge pressure. Oil (refrigerant oil) may pass through a fine passage between a first main bearing protrusion 1316*a* described hereinafter and the upper surface of the roller 134 so as to be introduced into the main back pressure pocket 1315*a*. The first main back pressure pocket 1315*a* may be formed in the range of a compression chamber forming the intermediate pressure in the compression space V. This may allow the first main back pressure pocket 1315*a* to maintain the intermediate pressure.

The second main back pressure pocket 1315*b* may form a pressure higher than that in the first main back pressure pocket 1315*a*, for example, a discharge pressure or intermediate pressure between a suction pressure close to the discharge pressure and the discharge pressure. Oil flowing into the main bearing hole 1312*a* of the main bearing 1312 through the first oil passage hole 126*a* may be introduced into the second main back pressure pocket 1315*b*. The second main back pressure pocket 1315*b* may be formed in the range of a compression chamber forming a discharge pressure in the compression space V. This may allow the second main back pressure pocket 1315*b* to maintain the discharge pressure.

In addition, a first main bearing protrusion 1316*a* and a second main bearing protrusion 1316*b* may be formed on inner circumferential sides of the first main back pressure pocket 1315*a* and the second main back pressure pocket 1315*b*, respectively, in a manner of extending from the main bearing surface 1312*b* of the main bush portion 1312. Accordingly, the first main back pressure pocket 1315*a* and the second main back pressure pocket 1315*b* may be sealed from outside and simultaneously the rotational shaft 123 may be stably supported.

The first main bearing protrusion 1316*a* and the second main bearing protrusion 1316*b* may have a same height or different heights. For example, when the first main bearing protrusion 1316*a* and the second main bearing protrusion 1316*b* have the same height, an oil communication groove (not illustrated) or an oil communication hole (not illustrated) may be formed on an end surface of the second main bearing protrusion 1316*b* such that inner and outer circumferential surfaces of the second main bearing protrusion 1316*b* may communicate with each other. Accordingly, high-pressure oil (refrigerant oil) flowing into the main bearing surface 1312*b* may be introduced into the second main back pressure pocket 1315*b* through the oil communication groove (not illustrated) or the oil communication hole (not illustrated).

On the other hand, when the first main bearing protrusion 1316*a* and the second main bearing protrusion 1316*b* have different heights, the height of the second main bearing protrusion 1316*b* may be lower than the height of the first main bearing protrusion 1316*a*. Accordingly, high-pressure oil (refrigerant oil) flowing into the main bearing hole 1312*a* may be introduced into the second main back pressure pocket 1315*b* by passing over the second main bearing protrusion 1316*b*.

The main bush portion 1312 may be formed in a hollow bush shape, for example, and a first oil groove 1312*c* may be formed in an inner circumferential surface of the main bearing hole 1312*a* that defines an inner circumferential surface of the main bush portion 1312. The first oil groove 1312*c* may be formed, for example, in a straight or inclined shape between upper and lower ends of the main bush portion 1312 to communicate with the first oil passage hole 126*a*.

Referring to FIGS. 1 to 3, the sub bearing 132 may be coupled to a lower end of the cylinder 133 in a close contact manner. Accordingly, the sub bearing 132 may define a lower surface of the compression space V, and support a lower surface of the roller 134 in the axial direction and at the same time support a lower portion of the rotational shaft 123 in the radial direction. The sub bearing 132 may include a sub plate portion 1321 and the sub bush portion 1322. The sub plate portion 1321 may cover a lower portion of the cylinder 133 to be coupled thereto, and the sub bush portion 1322 may axially extend from a center of the sub plate portion 1321 toward the lower shell 112 so as to support the lower portion of the rotational shaft 123. The sub plate portion 1321 may have a disk shape like the main plate portion 1311, and an outer circumferential surface of the sub plate portion 1321 may be spaced apart from the inner circumferential surface of the intermediate shell 111.

A first sub back pressure pocket 1325*a* and a second sub back pressure pocket 1325*b* may be formed on an upper surface, namely, a sub sliding surface 1321*a* of the sub plate portion 1321 facing the lower surface of the roller 134, of both axial side surfaces of the sub plate portion 1321. The first sub back pressure pocket 1325*a* and the second sub back pressure pocket 1325*b* may be symmetric to the first main back pressure pocket 1315*a* and the second main back pressure pocket 1315*b*, respectively, with respect to the roller 134.

For example, the first sub back pressure pocket 1325*a* and the first main back pressure pocket 1315*a* may be symmetric to each other, and the second sub back pressure pocket 1325*b* and the second main back pressure pocket 1315*b* may be symmetric to each other. A first sub bearing protrusion 1326*a* may be formed on an inner circumferential side of the first sub back pressure pocket 1325*a*, and a second sub bearing protrusion 1326*b* may be formed on an inner circumferential side of the second sub back pressure pocket 1325*b*.

Descriptions of the first sub back pressure pocket 1325*a* and the second sub back pressure pocket 1325*b*, and the first sub bearing protrusion 1326*a* and the second sub bearing protrusion 1326*b* are replaced by the descriptions of the first main back pressure pocket 1315*b* and the second main back pressure pocket 1316*b*, and the first main bearing protrusion 1316*a* and the second main bearing protrusion 1316*b*. However, in some cases, the first sub back pressure pocket 1325*a* and the second sub back pressure pocket 1325*b* may be asymmetric to the first main back pressure pocket 1315*a* and the second main back pressure pocket 1315*b*, respectively, with respect to the roller 134. For example, the first sub back pressure pocket 1325*a* and the second sub back pressure pocket 1325*b* may be deeper than the first main back pressure pocket 1315*a* and the second main back pressure pocket 1315*b*, respectively.

The sub bush portion 1322 may be formed in a hollow bush shape, for example, and an oil groove (not illustrated) may be formed in an inner circumferential surface of the sub bearing hole 1322*a* that defines an inner circumferential surface of the sub bush portion 1322. The oil groove (not illustrated) may be formed, for example, in a straight or inclined shape between upper and lower ends of the sub bush portion 1322 to communicate with the second oil passage hole 126*b*. Although not illustrated in the drawings, the back pressure pockets 1315*a*, 1315*b*, 1325*a*, 1325*b* may be provided only at any one of the main bearing 131 or the sub bearing 132.

The discharge port 1313 may be formed in the main bearing 131 as described above. However, the discharge port may be formed in the sub bearing 132, formed in each of the main bearing 131 and the sub bearing 132, or formed by penetrating between inner and outer circumferential surfaces of the cylinder 133. This embodiment describes an example in which the discharge ports 1313 are formed in the main bearing 131.

Only one discharge port 1313 may be provided. However, in this embodiment, the plurality of discharge ports 1313*a*, 1313*b*, and 1313*c* may be formed at predetermined intervals along a compression proceeding direction (or a rotational direction of the roller).

In general, in the vane rotary compressor, as the roller 134 is arranged eccentrically with respect to the compression space V, a contact point P at which the roller 134 and the cylinder 133 almost come in contact with each other is generated between outer circumferential surface 1341 of the roller 134 and inner circumferential surface 1332 of the cylinder 133. The discharge port 1313 may be formed adjacent to the contact point P at an opposite side of the suction port 1331 with respect to the contact point P. Accordingly, as the compression space V approaches the contact point P, a distance between the inner circumferential surface 1332 of the cylinder 133 and the outer circumferential surface 1341 of the roller 134 is greatly decreased, which makes it difficult to secure an area of the discharge port 1313.

Therefore, the discharge port 1313 according to this embodiment may be divided into a plurality of discharge ports 1313*a*, 1313*b*, and 1313*c* each having a small inner diameter, and the plurality of discharge ports 1313*a*, 1313*b*,

1313*c* may be disposed at preset or predetermined intervals along the circumferential direction, namely, the rotational direction of the roller 134.

In addition, the plurality of discharge ports 1313*a*, 1313*b*, and 1313*c* may be formed individually, but also may be formed as pairs, as illustrated in this embodiment. For example, starting from a discharge port which is the most adjacent to proximal portion 1332*a*, the first discharge port 1313*a*, the second discharge port 1313*b*, and the third discharge port 1313*c* of the discharge port 1313 may be sequentially arranged.

A distance between the adjacent discharge ports 1313*a*, 1313*b*, and 1313*c* may be formed to be substantially the same. For example, a first distance between a rear end of the first discharge port 1313*a* and a front end of the second discharge port 1313*b* may be substantially the same as a second distance between a rear end of the second discharge port 1313*b* and a front end of the third discharge port 1313*c*.

In addition, a distance from a front end to a rear end of the discharge port 1313, that is, an arcuate length of the discharge port 1313 may be substantially the same as an arcuate length of each compression chamber V1, V2, V3. For example, the arcuate length between the front end of the first discharge port 1313*a* and the rear end of the third discharge port 1313*b* may be approximately similar to a distance between a preceding vane and a succeeding vane, namely, the arcuate length of each compression chamber V1, V2, V3.

However, in some cases, the arcuate length between the front end of the first discharge port 1313*a* and the rear end of the third discharge port 1313*b* may be greater than the distance between a preceding vane and a succeeding vane, namely, the arcuate length of each compression chamber V1, V2, V3. In this case, continuous discharge may be allowed as at least one compression chamber V1, V2, V3 is located within a circumferential range of the discharge port 1313, which may prevent or suppress overcompression and/or pressure pulsation.

Although not illustrated, when vane slots 1346*a*, 1346*b*, and 1346*c* described hereinafter are formed at unequal intervals, a circumferential length of each compression chamber V1, V2, V3 may be different, and the plurality of discharge ports may communicate with one compression chamber or one discharge port may communicate with the plurality of compression chambers.

In addition, a discharge groove 1314 may extend from the discharge port 1313 according to this embodiment. The discharge groove 1314 may extend into an arcuate shape along a compression proceeding direction (the rotational direction of the roller). Accordingly, refrigerant, which is not discharged from a preceding compression chamber, may be guided to the discharge port 1313 communicating with a following compression chamber through the discharge groove 1314, so as to be discharged together with refrigerant compressed in the succeeding compression chamber. As a result, residual refrigerant in the compression space V may be minimized to thereby suppress overcompression or excessive compression. Thus, the efficiency of the compressor may be enhanced.

The discharge groove 1314 may extend from the last discharge port, for example, the third discharge port, 1313. In the vane rotary compressor, as the compression space V is divided into a suction chamber and a discharge chamber with the proximal portion (proximate point) 1332*a* interposed therebetween, the discharge port 1313 cannot overlap the proximate point P located at the proximal portion 1332*a* in consideration of sealing between the suction chamber and the discharge chamber. Accordingly, a refrigerant remaining space S by which the inner circumferential surface 1332 of the cylinder 133 and the outer circumferential surface 1341 of the roller 134 are spaced apart is formed between the proximate point P and the discharge port 1313 along the circumferential direction, and refrigerant which is not discharged through the last discharge port 1313 remains in the refrigerant remaining space S. This residual refrigerant may increase pressure of the last compression chamber, thereby causing a decrease in compression efficiency due to overcompression.

However, as in this embodiment, when the discharge groove 1314 extends from the last discharge port 1313 to the refrigerant remaining space S, refrigerant remaining in the refrigerant remaining space S may be discharged additionally by flowing back to the last discharge port 1313 through the discharge groove 1314, thereby effectively suppressing or preventing a decrease in compression efficiency due to overcompression in the last compression chamber.

Although not illustrated in the drawings, a residual refrigerant discharge hole (not illustrated) may be defined in the refrigerant remaining space S in addition to the discharge groove 1314. The residual refrigerant discharge hole may have a smaller inner diameter than the discharge port. Unlike the discharge port, the residual refrigerant discharge hole may be configured to remain open at all times, rather than being opened and closed by the discharge valve.

In addition, the plurality of discharge ports 1313*a*, 1313*b*, and 1313*c* may be opened and closed by discharge valves 1361, 1362, and 1363, respectively. Each of the discharge valves 1361, 1362, and 1363 may be implemented as a cantilever type reed valve having one end fixed and another end free. These discharge valves 1361, 1362, and 1362 are widely known in the conventional rotary compressor, so description thereof has been omitted.

Referring to FIGS. 1 to 3, the cylinder 133 according to this embodiment may be in close contact with a lower surface of the main bearing 131 and be coupled to the main bearing 131 by, for example, a bolt together with the sub bearing 132. Accordingly, the cylinder 133 may be fixedly coupled to the casing 110 by the main bearing 131.

The cylinder 133 may be formed in an annular shape having a hollow space in its center to define the compression space V. The hollow space may be sealed by the main bearing 131 and the sub bearing 132 to define the compression space V, and the roller 134 described hereinafter may be rotatably coupled to the compression space V.

The cylinder 133 may be provided with a suction port 1331 that penetrates from an outer circumferential surface to an inner circumferential surface thereof. However, the suction port may alternatively be formed through the main bearing 131 or the sub bearing 132.

The suction port 1331 may be formed on one side of the contact point P in the circumferential direction. The discharge port 1313 described above may be formed through the main bearing 131 at another side of the contact point P in the circumferential direction opposite to the suction port 1331.

The inner circumferential surface 1332 of the cylinder 133 may be formed in an elliptical shape. The inner circumferential surface 1332 of the cylinder 133 according to this embodiment may be formed in an asymmetric elliptical shape in which a plurality of ellipses, for example, four ellipses having different major and minor ratios are combined to have two origins.

For example, the inner circumferential surface 1332 of the cylinder 133 according to this embodiment may be defined to have a first origin O which is a center of the roller 134 or a center of rotation of the roller 134 (an axial center or a diameter center of the cylinder) or is biased by a first position from the center toward the contact point P, and a second origin O' biased from the first origin O toward the contact point P by a second position.

An X-Y plane formed around the first origin O may define a third quadrant Q3 and a fourth quadrant Q4, and an X-Y plane formed around the second origin O' may define a first quadrant O1 and a second quadrant Q2. The third quadrant Q3 may be formed by a third ellipse, the fourth quadrant Q4 may be formed by a fourth ellipse, the first quadrant O1 may be formed by the first ellipse, and the second quadrant Q2 may be formed by the second ellipse.

In addition, the inner circumferential surface 1332 of the cylinder 133 may include a proximal portion 1332*a*, a remote portion 1332*b*, and a curved portion 1332*c*. The proximal portion 1332*a* is a portion closest to the outer circumferential surface 1341 (or the center of rotation) of the roller 134, the remote portion 1332*b* is a portion farthest away from the outer circumferential surface 1341 of the roller 134, and the curved portion 1332*c* is a portion connecting the proximal portion 1332*a* and the remote portion 1332*b*. A point at which the cylinder 133 and the roller 134 are closest to each other on the proximal portion 1332*a* may also be defined as the contact point P, and the first quadrant Q1 and the fourth quadrant Q4 may be divided based on the proximal portion 1332*a*. The suction port 1331 may be formed in the first quadrant Q1 and the discharge port 1313 may be formed in the fourth quadrant Q4, based on the proximal portion 1332*a*. Accordingly, when the vane 1351, 1352, 1353 passes the contact point P, a compression surface of the roller 134 in the rotational direction may receive a suction pressure as a low pressure but an opposite compression rear surface may receive a discharge pressure as a high pressure. Then, while passing the contact point P, the roller 134 may receive the greatest fluctuating pressure between a front surface 1351*a*, 1352*a*, 1353*a* of each vane 1351, 1352, 1353 which comes in contact with the inner circumferential surface of the cylinder 133 and a rear surface 1351*b*, 1352*b*, 1353*b* of each vane 1351, 1352, 1353 which faces the back pressure chamber 1347*a*, 1347*b*, 1347*c*. This may cause tremor of the vane 1351, 1352, 1353 significantly.

Accordingly, in this embodiment, vane springs 1342*a*, 1342*b*, 1342*c*, which will be described hereinafter, may be disposed on the rear surfaces 1351*b*, 1352*b*, and 1353*b* of the vanes 1351, 1352, and 1353, respectively, to suppress the vanes 1351, 1352, and 1353 from being pushed backwards in the vicinity of the contact point P, thereby preventing tremors of the vanes 1351, 1352, and 1353 around the contact point P in advance. The vane springs 1342*a*, 1342*b*, and 1342*c* will be described hereinafter.

Referring to FIGS. 1 to 3, the roller 134 according to this embodiment may be rotatably disposed in the compression space V of the cylinder 133, and the plurality of vanes 1351, 1352, 1353 described hereinafter may be inserted in the roller 134 at predetermined intervals along the circumferential direction. Accordingly, the compression space V may be partitioned into as many compression chambers as the number of the plurality of vanes 1351, 1352, and 1353. This embodiment illustrates an example in which the plurality of vanes 1351, 1352, and 1353 is three, and thus, the compression space V is partitioned into three compression chambers V1, V2, and V3.

As described above, the roller 134 may extend integrally from the rotational shaft 123 or may be manufactured separately from the rotational shaft 123 and then post-assembled to the rotational shaft 123. This embodiment will be described based on an example in which the roller is post-assembled to the rotational shaft 123.

However, even when the roller 134 extends integrally from the rotational shaft 123, the rotational shaft 123 and the roller 134 may be formed similarly to those in this embodiment, and the basic operating effects thereof may also be substantially the same as those of this embodiment. However, when the roller 134 is post-assembled to the rotational shaft 123 as in this embodiment, the roller 134 may be formed of a material different from the rotational shaft 123, for example, a material lighter than that of the rotational shaft 123. This may facilitate processing of the roller body 1341 in which the vane springs 1342*a*, 1342*b*, and 1342*c* described hereinafter are disposed, and simultaneously lower a weight of a rotating body including the roller 134, thereby enhancing efficiency of the compressor.

The roller 134 according to this embodiment may be formed as a single body, that is, an integral roller having one roller body 1341. However, the roller 134 may not be necessarily formed as the integral roller. For example, the roller 134 may be formed as a separable roller which is separated into a plurality of roller bodies 1341. This will be described hereinafter in another embodiment. This embodiment will be described based on an integral roller 134 configured as a single body and the separable roller will be described hereinafter in another embodiment.

Referring to FIGS. 1 to 3, the roller 134 according to this embodiment may include a roller body 1341, and a plurality of vane springs 1342*a*, 1342*b*, and 1342*c*. The roller body 1341 may be formed in an annular shape by having a shaft hole 134*a* formed through the center thereof. For example, the roller body 1341 may have an inner circumferential surface 1341*a* and an outer circumferential surface 1341*b*, and the inner circumferential surface 1341*a* and the outer circumferential surface 1341*b* of the roller body 1341 may each be formed in a circular shape.

The inner circumferential surface 1341*a* of the roller body 1341 defining the shaft hole 134*a* may be formed as a continuous surface. In this case, the rotational shaft 123 may be press-fitted into the shaft hole 134*a* of the roller body 1341 to be integrally coupled thereto.

However, as in this embodiment, the rotational shaft 123 may be inserted into the shaft hole 134*a* of the roller body 1341 in the axial direction. In this case, an anti-idling portion 1341*c*, 123*b* of the roller 134 or the rotational shaft 123 may be formed between the inner circumferential surface 1341*a* of the roller body 1341 and the outer circumferential surface 123*a* of the rotational shaft 123. Accordingly, the inner circumferential surface 1341*a* of the roller body 1341 defining the shaft hole 134*a* may be formed as a discontinuous surface.

For example, as illustrated in FIGS. 2 and 3, a rotation preventing key 123*b* may protrude from the outer circumferential surface 123*a* of the rotational shaft 123 in the radial direction, and a rotation preventing groove 1341*a* may be recessed radially in the inner circumferential surface 1341*a* of the roller body 1341 corresponding thereto. The rotation preventing key 123*b* and the rotation preventing groove 1341*c* may have shapes corresponding to each other. For example, the rotation preventing key 123*b* and the rotation preventing groove 1341*c* may be formed in a rectangular shape extending lengthwise in the axial direction. Accordingly, the rotation preventing key 123*b* may be inserted into the rotation preventing groove 1341*c* to overlap it in the circumferential direction, thereby suppressing or preventing the rotational shaft 123 from idling with respect to the roller 134.

An axial length of the rotation preventing key 123*b* may be equal to or shorter than an axial length of the rotation preventing groove 1341*c*. For example, the axial length of the rotation preventing key 123*b* may be approximately 0.5 times shorter than the axial length of the rotation preventing groove 1341*c*. Accordingly, the rotational shaft 123 may slide relative to the roller 134 in the axial direction.

As described above, when the rotation preventing key 123*b* is shorter than the rotation preventing groove 1341*c* in the axial direction, the roller 134 may not move along the rotational shaft 123 in the axial direction even if the rotational shaft 123 moves in the axial direction together with the rotor 122. This may prevent damage due to friction or collision of the roller 134 with the main sliding surface 1311*a* of the main bearing 131 and/or the sub sliding surface 1321*a* of the sub bearing 132 and improve compression efficiency.

Although not illustrated, the rotation preventing key 123*b* and the rotation preventing groove 1341*a* may be provided as a plurality of pairs at uniform intervals along the circumferential direction. In this case, the roller 134 may be more firmly coupled to the rotational shaft 123 to more stably transmit a rotational force of the rotational shaft 123 to the roller 134.

In addition, although not illustrated, the outer circumferential surface 123*a* of the rotational shaft 123 and the inner circumferential surface 1341*a* of the roller body 1341 may be formed, for example, in a D-cut shape to be engaged with each other. In this case, the rotation preventing key and the rotation preventing groove may not be formed separately.

The outer circumferential surface 1341*b* of the roller body 1341 may be formed as a discontinuous surface. For example, the roller body 1341 may have vane slots 1346*a*, 1346*b*, and 1346*c*, which will be described hereinafter. The vane slots 1346*a*, 1346*b*, and 1346*c* may be formed to be open to the outer circumferential surface of the roller body 1341. Accordingly, the outer circumferential surface 1341*b* of the roller body 1341 may be formed as a discontinuous surface due to open surfaces of the vane slots 1346*a*, 1346*b*, and 1346*c*.

The outer circumferential surface 1341*b* of the roller body 1341 may be formed in the circular shape as described above, and a rotational center Or of the roller body 1341 may be coaxially formed with an axial center (no reference numeral given) of the rotational shaft 123. Accordingly, the roller body 1341 may concentrically rotate together with the rotational shaft 123.

However, as described above, as the inner circumferential surface 1332 of the cylinder 133 may be formed in the asymmetric elliptical shape biased in a specific direction, the rotational center Or of the roller body 1341 may be biased with respect to an outer diameter center Oc of the cylinder 133. Accordingly, one side of the outer circumferential surface 1341*b* of the roller body 1341 may be almost brought into contact with the inner circumferential surface 1332 of the cylinder 133, precisely, the proximal portion 1332*a*, thereby defining the contact point P.

The contact point P may be formed in the proximal portion 1332*a* as described above. Accordingly, an imaginary line passing through the contact point P may correspond to a minor axis of an elliptical curve defining the inner circumferential surface 1332 of the cylinder 133.

The roller body 1341 may have the plurality of vane slots 1346*a*, 1346*b*, and 1346*c*, into which the vanes 1351, 1352, and 1353 described hereinafter are slidably inserted, respectively. The plurality of vane slots 1346*a*, 1346*b*, and 1346*c* may be formed at preset or predetermined intervals along the circumferential direction. The outer circumferential surface 1341*b* of the roller body 1341 may have open surfaces which are open in the radial direction. Back pressure chambers 1347*a*, 1347*b*, and 1347*c* and spring insertion grooves 1348*a*, 1348*b*, and 1348*c*, which will be described hereinafter, may be formed in inner end portions which are opposite to the open surfaces, so as to have a closed shape in the radial direction.

The plurality of vane slots 1346*a*, 1346*b*, and 1346*c* may be defined as a first vane slot 1346*a*, a second vane slot 1346*b*, and a third vane slot 1346*c* along a compression-progressing direction (the rotational direction of the roller). The first vane slot 1346*a*, the second vane slot 1346*b*, and the third vane slot 1346*c* may be formed at uniform or non-uniform intervals along the circumferential direction.

For example, each of the vane slots 1346*a*, 1346*b*, and 1346*c* may be inclined by a preset or predetermined angle with respect to the radial direction, so as to secure a sufficient length of each of the vanes 1351, 1352, and 1353. Accordingly, when the inner circumferential surface 1332 of the cylinder 133 is formed in the asymmetric elliptical shape, even if a distance from the outer circumferential surface 1341*b* of the roller body 1341 to the inner circumferential surface 1332 of the cylinder 133 increases, separation of the vanes 1351, 1352, and 1353 from the vane slots 1346*a*, 1346*b*, and 1346*c* may be suppressed or prevented, which may result in enhancing design freedom for the inner circumferential surface 1332 of the cylinder 133 as well as that of the roller 134.

A direction in which the vane slots 1346*a*, 1346*b*, and 1346*c* are inclined may be a reverse direction to the rotational direction of the roller 134. That is, the front surfaces 1351*a*, 1352*a*, and 1353*a* of the vanes 1351, 1352, and 1353 in contact with the inner circumferential surface 1332 of the cylinder 133 may be tilted toward the rotational direction of the roller 134. This may be advantageous in that a compression start angle may be formed ahead in the rotational direction of the roller 134 so that compression may start quickly.

The back pressure chambers 1347*a*, 1347*b*, and 1347*c* may be formed to communicate with the inner ends of the vane slots 1346*a*, 1346*b*, and 1346*c*, respectively. The back pressure chambers 1347*a*, 1347*b*, and 1347*c* may be spaces in which oil (or refrigerant) of a discharge pressure or intermediate pressure is filled to flow toward the rear sides of the vanes 1351, 1352, and 1353, that is, the rear surfaces 1351*c*, 1352*c*, and 1353*c* of the vanes 1351, 1352, 1353. The vanes 1351, 1352, and 1353 may be pressed toward the inner circumferential surface of the cylinder 133 by the pressure of the oil (or refrigerant) filled in the back pressure chambers 1347*a*, 1347*b*, and 1347*c*. Hereinafter, a direction toward the inner circumferential surface of the cylinder based on a motion direction of the vane may be defined as the front, and an opposite side to the direction may be defined as the rear.

Although not illustrated, the plurality of vane slots 1346*a*, 1346*b*, and 1346*c* may be formed in the radial direction, that is, radially with respect to the rotational center Or of the roller 134. In this case as well, the vane springs 1342*a*, 1342*b*, and 1342*c* described hereinafter may be disposed at the rear sides of the vanes 1351, 1352, and 1353, respectively. Operating effects to be obtained by the configuration are similar to those in the following embodiment in which the plurality of vane slots 1346*a*, 1346*b*, and 1346*c* are inclined with respect to the rotational center Or of the roller 134, which will be described hereinafter, so description thereof will be replaced with description of the embodiment hereinafter.

The back pressure chamber 1342*a*, 1342*b*, 1342*c* may be hermetically sealed by the main bearing 131 and the sub bearing 132. The back pressure chambers 1347*a*, 1347*b*, and 1347*c* may independently communicate with each of the back pressure pockets 1315*a* and 1315*b*, 1325*a* and 1325*b*, and may also communicate with each other through the back pressure pockets 1315*a* and 1315*b* and 1325*a* and 1325*b*.

Each of spring insertion grooves 1348*a*, 1348*b*, and 1348*c* into which the vane springs 1342*a*, 1342*b*, and 1342*c*, which will be described hereinafter, are respectively inserted, may be formed in one side of each of the back pressure chambers 1347*a*, 1347*b*, and 1347*c* in the axial direction. For example, a first spring insertion groove 1348*a* may be formed in an inner end portion of the first vane slot 1346*a* in a slot direction or lengthwise direction of the slot, a second spring insertion groove 1348*b* may be formed in an inner end portion of the second vane slot 1346*b* in the slot direction or lengthwise direction of the slot, and a third spring insertion groove 1348*c* may be formed in an inner end portion of the third vane slot 1346*c* in the slot direction or lengthwise direction of the slot. First vane spring 1342*a* described hereinafter may be inserted into the first spring insertion groove 1248*a*, second vane spring 1342*b* described hereinafter may be inserted into the second spring insertion groove 1348*b*, and third vane spring 1342*c* described hereinafter may be inserted into the third spring insertion groove 1348*c*. The first spring insertion groove 1348*a* may be located between the first vane slot 1346*a* and the first back pressure chamber 1347*a*, the second spring insertion groove 1348*b* may be located between the second vane slot 1346*b* and the second back pressure chamber 1347*b*, and the third spring insertion groove 1348*c* may be located between the third vane slot 1346*c* and the third back pressure chamber 1347*c*.

The first spring insertion groove 1348*a*, the second spring insertion groove 1348*b*, and the third spring insertion groove 1348*c* may be formed in one or a first axial side surface of the roller body 1341 to overlap the vane slots 1346*a*, 1346*b*, and 1346*c* and the back pressure chambers 1347*a*, 1347*b*, and 1347*c*, respectively. Accordingly, rear surfaces 1351*b*, 1352*b*, and 1353*b* of the respective vanes 1351, 1352, and 1353 described hereinafter, which are inserted into the respective vane slots 1346*a*, 1346*b*, and 1346*c* may be elastically supported in the vane slots 1346*a*, 1346*b*, and 1346*c* by the vane springs 1342*a*, 1342*b*, and 1342*c* toward the inner circumferential surface 1332 of the cylinder 133 in a lengthwise direction of the slot (hereinafter, the slot direction). The spring insertion grooves 1348*a*, 1348*b*, and 1348*c* will be described again together with the vane springs 1342*a*, 1342*b*, and 1342*c*.

Referring to FIGS. 1 to 3, the plurality of vanes 1351, 1352, 1353 according to this embodiment may be slidably inserted into the respective vane slots 1346*a*, 1346*b*, and 1346*c*. Accordingly, the plurality of vanes 1351, 1352, and 1353 may have substantially a same shape as the respective vane slots 1346*a*, 1346*b*, and 1346*c*.

For example, the plurality of vanes 1351, 1352, 1353 may include first vane 1351, second vane 1352, and third vane 1353 along the rotational direction of the roller 134. The first vane 1351 may be inserted into the first vane slot 1346*a*, the second vane 1352 into the second vane slot 1346*b*, and the third vane 1353 into the third vane slot 1346*c*, respectively.

The plurality of vanes 1351, 1352, and 1353 may have substantially a same shape. For example, the plurality of vanes 1351, 1352, and 1353 may each be formed in a substantially rectangular parallelepiped shape, and front surfaces 1351*a*, 1352*a*, 1353*a* of the vanes 1351, 1352, and 1353 in contact with the inner circumferential surface 1332 of the cylinder 133 may be curved in the circumferential direction. Accordingly, the front surfaces 1351*a*, 1352*a*, and 1353*a* of the vanes 1351, 1352, and 1353 may come into line-contact with the inner circumferential surface 1332 of the cylinder 133, thereby reducing friction loss.

Referring to FIGS. 2 and 3, the vane springs 1342*a*, 1342*b*, and 1342*c* according to this embodiment may be configured as compression coil springs, to be inserted into the respective spring insertion grooves 1348*a*, 1348*b*, and 1348*c*. Accordingly, the vane springs 1342*a*, 1342*b*, and 1342*c* may elastically support rear surfaces 1351*b*, 1352*b*, and 1353*b* of the vanes 1351, 1352, and 1353, respectively, in a forward direction.

First ends 1342*a*1, 1342*b*1, 1342*c*1 defining rear ends of the respective vane springs 1342*a*, 1342*b*, and 1342*c* may be supported in contact with first spring fixing surfaces 1349*a*, 1348*b*1, and 1348*c*1 of the spring insertion grooves 1348*a*, 1348*b*, and 1348*c*. Second ends 1342*a*2, 1342*b*2, and 1342*c*2 defining front ends of the respective vane springs 1342*a*, 1342*b*, and 1342*c* may be supported in contact with second spring fixing surfaces 1349*b* of the spring insertion grooves 1348*a*, 1348*b*, 1348*c* or may elastically support the vanes 1351, 1352, and 1353 by being in contact with the respective rear surfaces 1351*b*, 1352*b*, and 1353*b* of the vanes 1351, 1352, and 1353, depending on positions of the vanes 1351, 1352, and 1353. The vane springs 1342*a*, 1342*b*, and 1342*c* will be described hereinafter together with the spring insertion grooves 1348*a*, 1348*b*, and 1348*c*.

In the drawings, an unexplained reference numeral 1351*d* denotes an oil supply groove.

In the vane rotary compressor having the hybrid cylinder, when power is applied to the drive motor 120, the rotor 122 of the drive motor 120 and the rotational shaft 123 coupled to the rotor 122 rotate together, causing the roller 134 coupled to the rotational shaft 123 or integrally formed therewith to rotate together with the rotational shaft 123. Then, the plurality of vanes 1351, 1352, and 1353 may be drawn out of the vane slots 1346*a*, 1346*b*, and 1346*c* by centrifugal force generated by the rotation of the roller 134 and back pressure of the back pressure chambers 1347*a*, 1347*b*, and 1347*c*, which support the rear surfaces 1351*b*, 1353*b*, 1353*b* of the vanes 1351, 1352, and 1353, thereby being brought into contact with the inner circumferential surface 1332 of the cylinder 133.

Then, the compression space V of the cylinder 133 may be partitioned by the plurality of vanes 1351, 1352, and 1353 into as many compression chambers (including a suction chamber or discharge chamber) V1, V2, and V3 as the number of the vanes 1351, 1352, and 1353. The compression chambers V1, V2, and V3 may be changed in volume by the shape of the inner circumferential surface 1332 of the cylinder 133 and eccentricity of the roller 134 while moving in response to the rotation of the roller 134. Accordingly, refrigerant suctioned into the respective compression chambers V1, V2, and V3 may be compressed while moving along the roller 134 and the vanes 1351, 1352, and 1353, and discharged into the inner space of the casing 110. Such series of processes may be repeatedly carried out.

On the other hand, as described above, in the vane rotary compressor according to this embodiment, the front surfaces 1351*a*, 1352*a*, and 1353*a* of the vanes 1351, 1352, 1353 may simultaneously receive compression pressure and suction pressure in a section from the contact point P between the cylinder 133 and the roller 134 and the suction port 1331. For this reason, each of the vanes 1351, 1352, and 1353 may trembled more in this section than in other sections due to pressure imbalance. The trembling of the vanes 1351, 1352, and 1353 may cause leakage between the compression chambers and hitting noise and vibration between the cylinder 1333 and each of the vanes 1351, 1352, and 1353. In addition, the inner circumferential surface 1332 of the cylinder 133 or the front surfaces 1351*a*, 1352*a*, and 1353*a* of the vanes 1351, 1352, and 1353 may be worn, which may aggregate suction loss and compression loss. Accordingly, in this embodiment, the vane springs 1342*a*, 1342*b*, and 1342*c* that elastically support the vanes 1351, 1352, and 1353 toward the inner circumferential surface 1332 of the cylinder 133 may be disposed inside of the roller 134, to suppress the vanes 1351, 1352, and 1353 from being pushed backwards, thereby preventing the tremors of the vanes 1351, 1352, and 1353.

Figure 4:
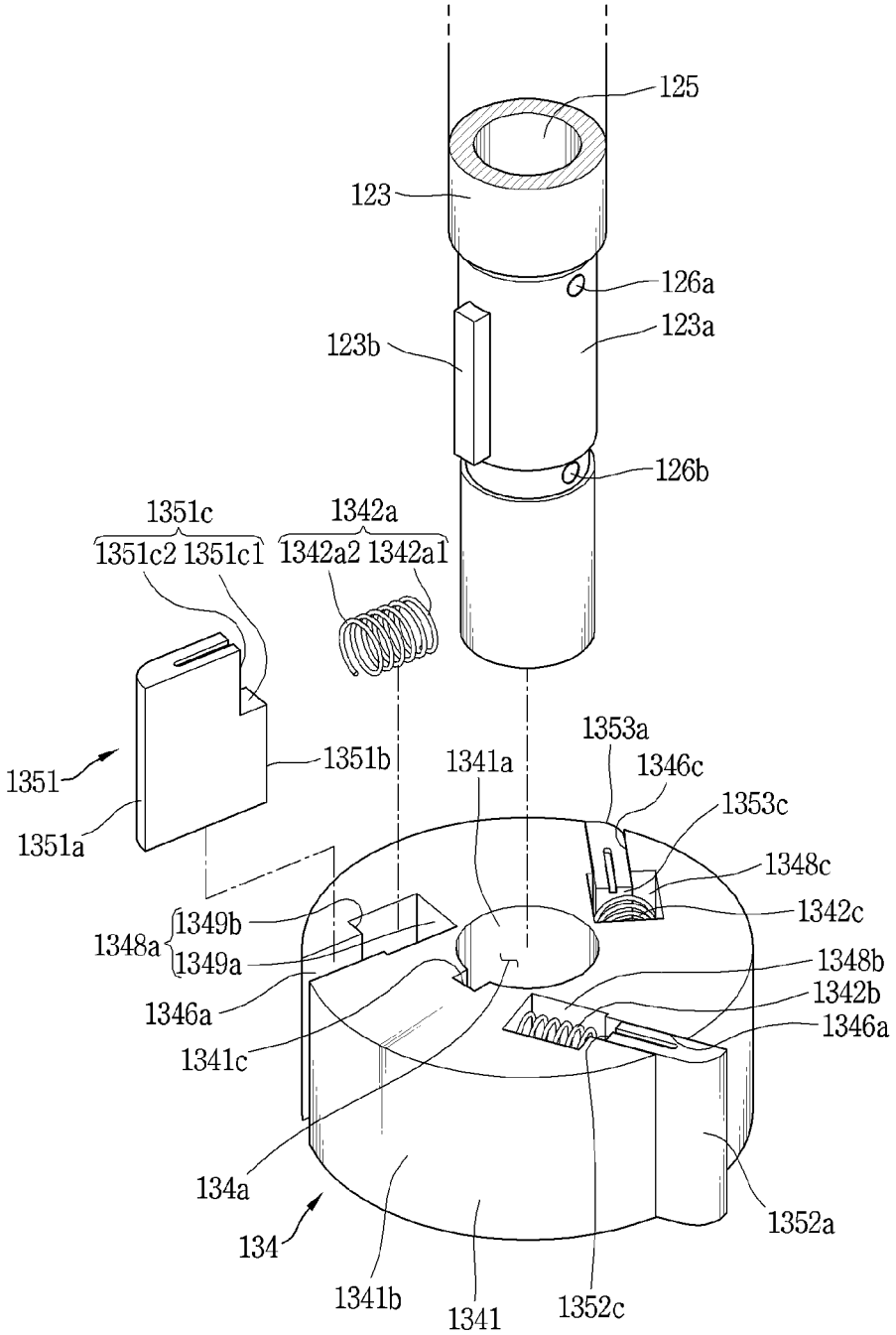
FIG. 4 is an exploded perspective view of a rotational shaft and a roller in FIG. 2.
Figure 5:
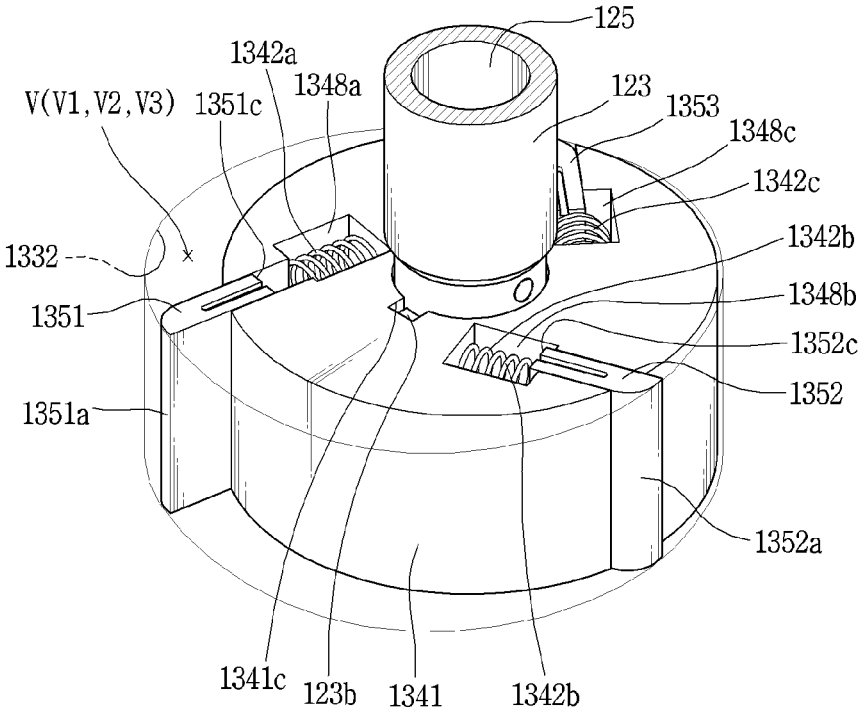
FIG. 5 is an assembled perspective view of the rotational shaft and the roller in FIG. 4.

FIG. 4 is an exploded perspective view of a rotational shaft and a roller in FIG. 2. FIG. 5 is an assembled perspective view of the rotational shaft and the roller in FIG. 4.

Referring to FIGS. 4 and 5, the spring insertion grooves 1348*a*, 1348*b*, and 1348*c* may be formed at inner end portions of the vane slots 1346*a*, 1346*b*, and 1346*c* in the slot direction, namely, in end portions opposite to open surfaces of the vane slots 1346*a*, 1346*b*, and 1346*c* between the vane slots 1346*a*, 1346*b*, and 1346*c* and the back pressure chambers 1347*a*, 1347*b*, and 1347*c*. For example, the spring insertion grooves 1348*a*, 1348*b*, and 1348*c* may be recessed by predetermined depths from an upper surface of the roller body 1341 in the axial direction to overlap the vane slots 1346*a*, 1346*b*, and 1346*c* and the back pressure chambers 1347*a*, 1347*b*, and 1347*c*, respectively, in the axial direction.

The vane springs 1342*a*, 1342*b*, and 1342*c* for that elastically support the rear surfaces 1351*b*, 1352*b*, and 1353*b* of the vanes 1351, 1352, and 1353 in the slot direction (a centrifugal direction) toward the inner circumferential surface 1332 of the cylinder may be inserted into the spring insertion grooves 1348*a*, 1348*b*, and 1348*c*, respectively. In this case, spring support portions 1351*c*, 1352*c*, and 1353*c* each of which supports one end of each of the vane springs 1342*a*, 1342*b*, and 1342*c* may be formed on the rear surfaces 1351*b*, 1352*b*, and 1353*b* of the vanes 1351, 1352, and 1353. The spring support portions 1351*c*, 1352*c*, and 1353*c* may be stepped to correspond to the spring insertion grooves 1348*a*, 1348*b*, and 1348*c*, respectively.

The vane springs 1342*a*, 1342*b*, and 1342*c* may be configured as compression coil springs having a same elasticity. For example, each of the vane springs 1342*a*, 1342*b*, and 1342*c* may have a same wire diameter, free state length, and maximum compressed length. This may constantly maintain surface pressure between the cylinder 133 and the vanes 1351, 1352, and 1353 which is generated on the same inner circumferential surface 1332 of the cylinder 133.

In addition, each of the vane springs 1342*a*, 1342*b*, and 1342*c* may have a same outer diameter. This may facilitate not only processing of the spring insertion grooves 1348*a*, 1348*b*, and 1348*c*, but also insertion of the vanes 1351, 1352, and 1353 into the spring insertion grooves 1348*a*, 1348*b*, and 1348*c*.

The vane slots 1346*a*, 1346*b*, 1346*c*, the spring insertion grooves 1348*a*, 1348*b*, 1348*c*, the vane 1351, 1352, 1353 including the spring support portions 1351*c*, 1352*c*, and 1353*c*. The vane springs 1342*a*, 1342*b*, and 1342*c* may form pairs, respectively, and the pairs of the vane slots 1346*a*, 1346*b*, 1346*c*, the spring insertion grooves 1348*a*, 1348*b*, 1348*c*, the vanes 1351, 1352, 1353, including the spring support portions 1351*c*, 1352*c*, and 1353*c*, and the vane springs 1342*a*, 1342*b*, and 1342*c* may be formed to have the same shape and specification.

Hereinafter, first spring insertion groove 1348*a*, first vane spring 1342*a*, and first vane 1351 that form a pair with first vane slot 1346*a* are defined as a first group, and will be described as a representative example. However, embodiments are not be limited to the first group including the first vane 1351, but it will be understood that the embodiments may equally be applied to a second group including a second vane 1352 and a third group including a third vane 1353. It will also be understood that the same may be applied even when more vanes are provided.

Figure 6:
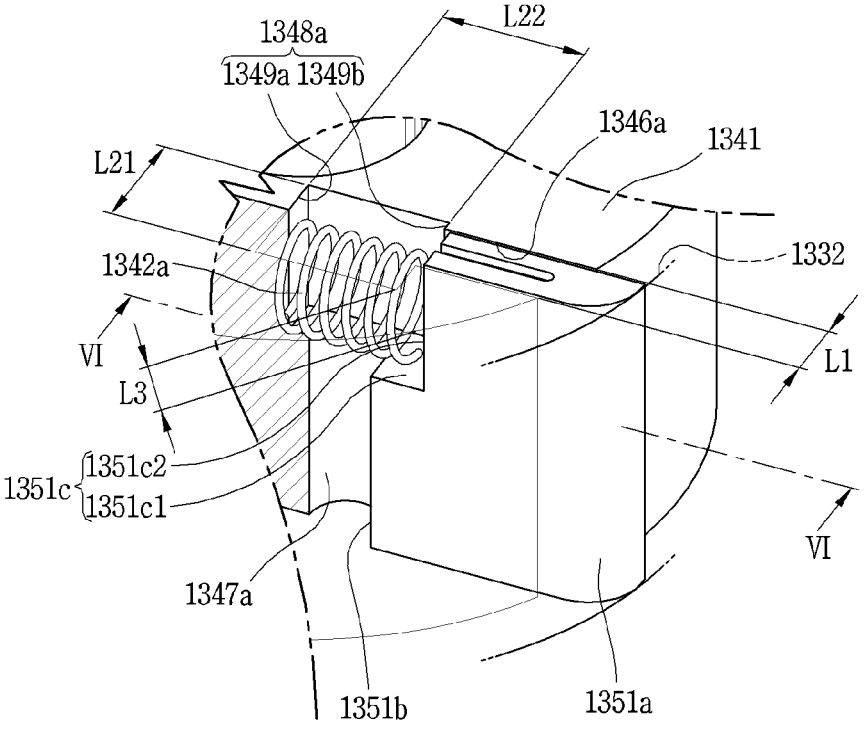
FIG. 6 is an enlarged perspective view of a portion of the compression unit of FIG. 5.
Figure 7:
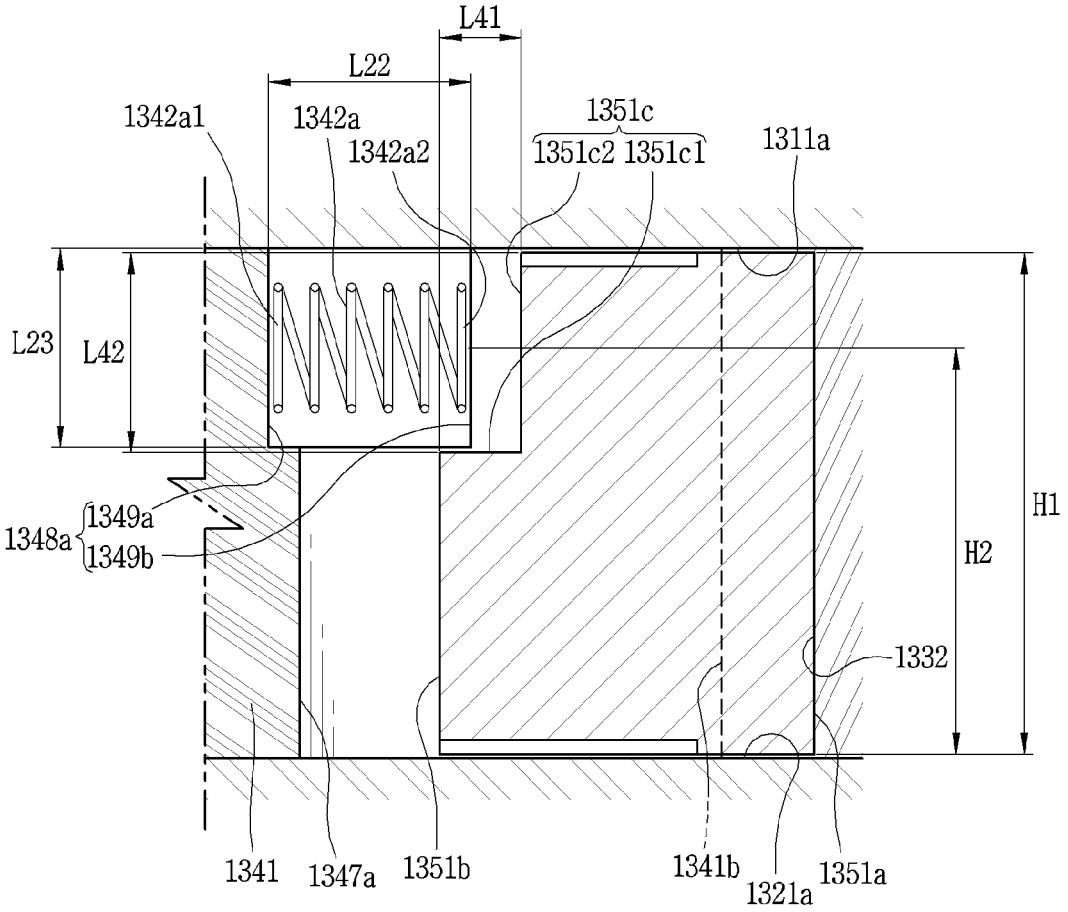
FIG. 7 is a cross-sectional view, taken along line "VII-VII" of FIG. 6.
Figure 8:
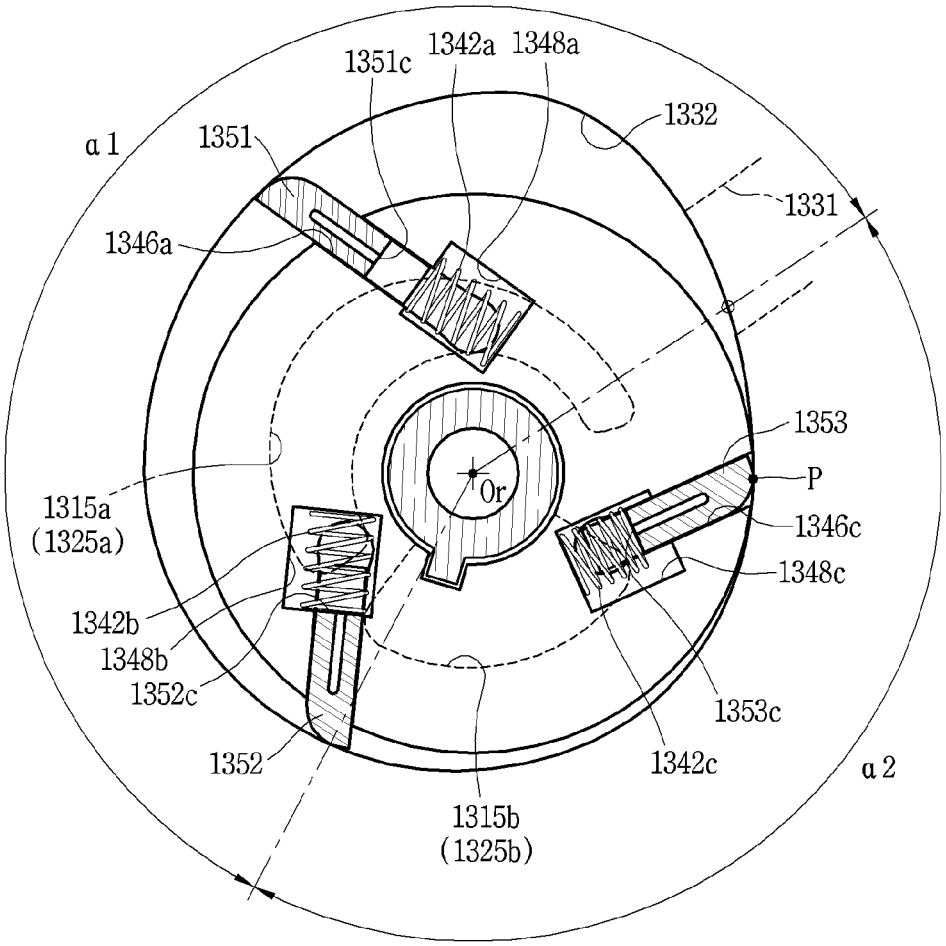
FIG. 8 is a schematic view illustrating a relationship with a vane spring according to a position of a vane in FIG. 5.

FIG. 6 is an enlarged perspective view of a portion of the compression unit of FIG. 5. FIG. 7 is a cross-sectional view, taken along line "VII-VII" of FIG. 6. FIG. 8 is a schematic view illustrating a relationship with a vane spring according to a position of a vane in FIG. 5.

Referring to FIGS. 6 and 7, the first spring insertion groove 1348*a* according to this embodiment, as aforementioned, may be recessed axially by a preset or predetermined depth in an upper half portion of the roller body 1341, namely, the upper surface of the roller 134 facing the discharge port 1313.

The first spring insertion groove 1348*a* may be located at a position overlapping the first back pressure chamber 1347*a* in the axial direction so as to communicate with the rear end portion of the first vane slot 1346*a*. Accordingly, the first spring insertion groove 1348*a* may communicate with the first main back pressure pocket 1315*a* and the second main back pressure pocket 1315*b* disposed in the main bearing 131, so as to serve as the first back pressure chamber 1347*a*.

The first spring insertion groove 1348*a* may have a rectangular cross-sectional shape when projected in the axial direction, so that a major axis (or minor axis) may be the same as or parallel to the slot direction. Accordingly, an inner surface and an outer surface of the first spring insertion groove 1348*a* may be orthogonal to the slot direction at both sides of the slot direction, respectively.

For example, the first spring insertion groove 1348*a* according to this embodiment may include a first spring fixing surface 1349*a* disposed at one or a first side in the slot direction and a second spring fixing surface 1349*b* disposed at another or a second side in the slot direction. The first spring fixing surface 1349*a* may define the inner surface of the first spring insertion groove 1348*a* and may be located adjacent to the rotational center Or of the roller body 1341. The second spring fixing surface 1349*b* may define the outer surface of the first spring inserting groove 1348*a*, and may be located farther from the center of the roller body 1341 than the first spring fixing surface 1349*a*.

The first spring fixing surface 1349*a* and the second spring fixing surface 1349*b* may be orthogonal to the slot direction, respectively. A lateral width L21 (a length in an orthogonal direction to the slot direction) of the first spring fixing surface 1349*a* and the second spring fixing surface 1349*b* may be greater than a lateral length L1 of the first vane slot 1346*a*.

In this case, the second spring fixing surface 1349*b* may be spaced apart from the outer circumferential surface of the roller 134 to an extent capable of securing an appropriate sealing distance L3. For example, the sealing distance L3 may be greater than or equal to half of the lateral width L1 of the first vane slot 1346*a*. More specifically, the sealing distance may be about 1.5 to 2 mm or more. This may suppress or prevent leakage between the compression chambers through the first spring insertion groove 1348*a*.

In addition, a distance L22 in the slot direction between the first spring fixing surface 1349*a* and the second spring fixing surface 1349*b* (equal to a length of the spring insertion groove in the slot direction) may be greater than a maximum compression state length of the first vane spring 1342*a*. Accordingly, a first end 1342*a*1 of the first vane spring 1342*a* inserted into the first spring insertion groove 1348*a* may be supported on the first spring fixing surface 1349*a*, and a second end 1342*a*2 of the first vane spring 1342*a* may be supported on the second spring fixing surface 1349*b*.

At this time, as described above, the distance L22 in the slot direction between the first spring fixing surface 1349*a* and the second spring fixing surface 1349*b* may be shorter than or equal to the free state length of the first vane spring 1342*a*. Therefore, both ends of the first vane spring 1342*a* may be fixed in close contact with the first spring fixing surface 1349*a* and the second spring fixing surface 1349*b*, respectively.

Referring to FIGS. 6 and 7, the first vane 1351 according to this embodiment may be generally formed in the rectangular parallelepiped shape as described above, and the rear surface 1351*b* of the first vane 1351 facing the first back pressure chamber 1347*a* may be stepped. For example, the first vane 1351 may include a first spring support portion 1351*c* that is formed in a stepped shape on an upper edge where the rear surface 1351*b* of the first vane 1351 and one side surface (upper surface) in the axial direction are connected. Accordingly, the first spring support portion 1351*c* may overlap the second end 1342*a*2 of the first vane spring 1342*a* in a second section α2 described hereinafter in the axial direction.

The first spring support portion 1351*c* may be formed to correspond to the first spring insertion groove 1348*a*. For example, the first spring support portion 1351*c* may be formed to be stepped at a right angle on the upper edge of the rear surface of the first vane 1351.

More specifically, the first spring support portion 1351*c* according to this embodiment may include a first support surface 1351*c*1 and a second support surface 1351*c*2. The first support surface 1351*c*1 may extend in the slot direction, and the second support surface 1351*c*2 may extend from a front end of the first support surface 1351*c*1 toward an axial upper surface of the first vane 1351. The first support surface 1351*c*1 may be flat or may be curved to correspond to the outer circumferential surface of the first vane spring 1342*a*.

A length of the first support surface 1351*c*1 in the slot direction may be defined as a slot-direction length L41 of the first spring support portion 1351*c*. The slot-direction length L41 of the first support surface 1351*c*1 may be set such that the second support surface 1351*c*2 is located inside of the first vane slot 1346*a* in sections except for a specific section, whereas the second support surface 1351*c*2 protrudes to the outside of the first vane slot 1346*a* in the specific section.

For example, the slot-direction length L41 of the first spring support portion 1351*c* may be set such that the second support surface 1351*c*2 is located inside of the first vane slot 1346*a* when the front surface 1351*a* of the first vane 1351 passes through the first section α1 including the remote portion 1332*b* of the cylinder 133 while being located inside of the first spring insertion groove 1348*a* by protruding to the outside of the first vane slot 1346*a* when the front surface 1351*a* of the first vane 1351 passes through the second section α2 including the proximal portion 1332*a* of the cylinder 133. In other words, the slot-direction length L41 of the first spring support portion 1351*c* may be set such that the first spring support portion 1351*c* does not protrude more rearward than the second spring fixing surface 1349*b* of the first spring insertion groove 1348*a* in the first section α1 including a suction stroke and a compression stroke but protrudes more rearward than the second spring fixing surface 1349*b* of the first spring insertion groove 1348*a* in the second section α2 including a discharge stroke (or a part of the compression stroke and a part of the suction stroke). Accordingly, the first vane 1351 may be spaced apart from the first vane spring 1342*a* in the first section α1, while being elastically supported by the first vane spring 1342*a* in the second section α2. With this configuration, the first vane 1351 may be supported in the slot direction in the second section α2 by a pressing force F which is a sum of a centrifugal force F1, a back pressure F2 of the first back pressure chamber 1347*a*, and an elastic force F3 of the first vane spring 1342*a* inserted in the first spring insertion groove 1348*a*.

In addition, the slot-direction length L41 of the first support surface 1351*c*1 may be set to be less than ½ of the slot-direction length of the first vane 1351, and may be set such that the second support surface 1351*c*2 is located inside of the first vane slot 1346*a* without being exposed to outside of the open surface of the roller in the first section α1. This may result in suppressing or preventing leakage between the compression chambers through the first spring support portion 1351*c*.

The second support surface 1351*c*2 may be formed to be flat so that the second end 1342*a*2 of the first vane spring 1342*a* may be in close contact. The second support surface 1351*c*2 may have an axial depth L42 that is greater than an axial depth L23 of the first spring insertion groove 1348*a*. This may prevent the first support surface 1351*c*1 of the first spring support portion 1351*c* from being in contact with the first vane spring 1342*a* inserted into the first spring insertion groove 1348*a*, thereby increasing reliability of the first vane 1351 and the first vane spring 1342*a*.

For example, the axial depth L42 of the second support surface 1351*c*2 may be smaller than an axial height H1 of the first vane 1351 or the roller 134, but may be set to be smaller than ½ of the axial height H1 of the first vane 1351 or the roller, as illustrated in FIG. 7. Accordingly, an axial height H2 of the first vane spring 1342*a* may be greater than a middle of the first vane 1351.

In other words, the first spring support portion 1351*c* may be formed at an edge between the upper surface of the first vane 1351 facing the main bearing and the rear surface 1351*b*. With this configuration, even if a pressure on an upper half of the first vane 1351 adjacent to the discharge port 1313 is relatively higher than a pressure on a lower half of the first vane 1351 on the opposite side, the upper half of the first vane 1351 may be supported by the first vane spring 1342*a*, which may result in balancing the pressing force F at both sides of the first vane 1351 in the axial direction. This may suppress or prevent inclination of the first vane 1351 to prevent uneven wear in advance, thereby more effectively suppressing or preventing refrigerant leakage.

Referring to FIGS. 6 and 7, the first vane spring 1342*a* according to this embodiment may be configured as the compression coil spring. For example, the first vane spring 1342*a* may have the first end 1342*a*1 and the second end 1342*a*2. A maximum length between the first end 1342*a*1 and the second end 1342*a*2, that is, a free state length of the first vane spring 1342*a* may be greater than or equal to the slot-direction distance L22 between the first spring fixing surface 1349*a* and the second spring fixing surface 1349*b*. Accordingly, the first end 1342*a*1 of the first vane spring 1342*a* may be in close contact with the first spring fixing surface 1349*a*, and the second end 1342*a*2 of the first vane spring 1342*a* may be in close contact with the second spring fixing surface 1349*b*, thereby preventing separation of the first vane spring 1342*a*.

An outer diameter of the first vane spring 1342*a* may be set such that the first vane spring 1342*a* does not fit inside of the first vane slot 1346*a*, for example, set to be greater than the lateral width L1 of the first vane slot 1346*a*. More specifically, the outer diameter of the first vane spring 1342*a* may be greater than ½ of the lateral width L1 of the first spring fixing surface 1349*a*. Accordingly, even if the second end 1342*a*2 of the first vane spring 1342*a* is twisted with respect to the slot direction, the second end 1342*a*2 of the first vane spring 1342*a* may be prevented from fitting in the first vane slot 1346*a*, such that the first vane spring 1342*a* may stably support the first vane 1351.

Although not illustrated, the outer diameter of the first vane spring 1342*a* may be smaller than the lateral width L1 of the first vane slot 1346*a*. In this case, the first vane spring 1342*a* may be inserted into the first vane slot 1346*a* so that the first vane 1351 may be supported only by the first vane spring 1342*a*. Then, the aforementioned back pressure pockets 1315*a* and 1315*b*, 1325*a* and 1325*b* may be excluded from each of the bearings 131 and 132, thereby simplifying the structure of the compression unit. In addition, the bearing surface supporting the rotational shaft may be formed in an annular shape, so as to more stably support the rotational shaft.

Although not illustrated, even when the outer diameter of the first vane spring 1342*a* is greater than the lateral width L1 of the first vane slot 1346*a*, the first spring insertion groove 1348*a* may extend in the slot direction from both rear inner surfaces of the first vane slot 1346*a*. In this case, the first vane spring 1342*a* may be inserted into the first vane slot 1346*a* so that the first vane 1351 may be supported only by the first vane spring 1342*a*. The operating effects thereof may be similar to those of the previous embodiment.

In the vane rotary compressor according to this embodiment, when the first vane 1351 passes through most of the remote portion 1332*b* and the curved portion 1332*c* of the cylinder 133 including the first section α1, the first vane 1351 may be spaced apart from the first vane spring 1342*a*, thereby suppressing or preventing friction loss. On the other hand, when the first vane 1351 passes through the proximal portion 1332*c* including the second section α2, the first vane 1351 may be brought into contact with the first vane spring 1342*a* and pressed toward the inner circumferential surface of the cylinder 133, thereby suppressing or preventing trembling of the vane.

Figure 9A:
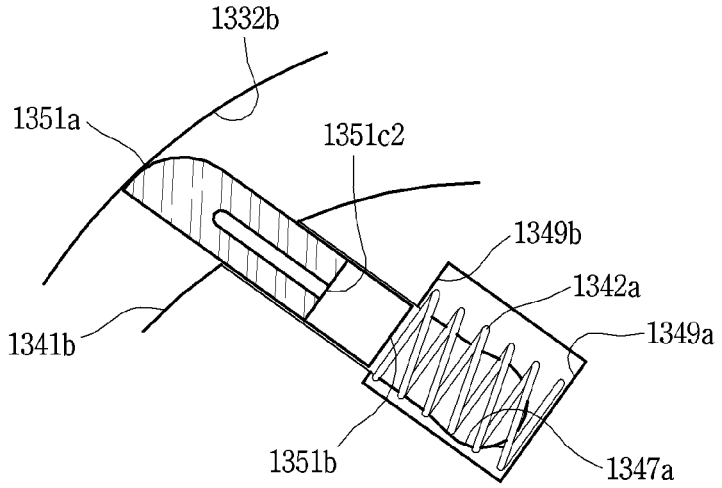
FIGS. 9A and 9B are enlarged schematic views illustrating a support state of a vane for each position in FIG. 8, where
Figure 9B:
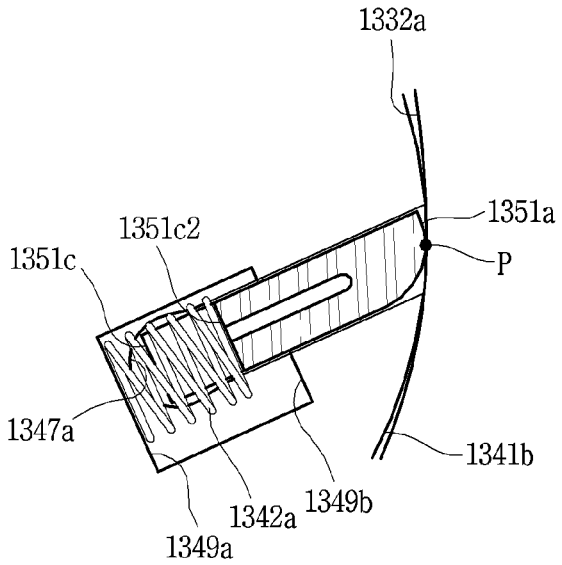
Figure 10:
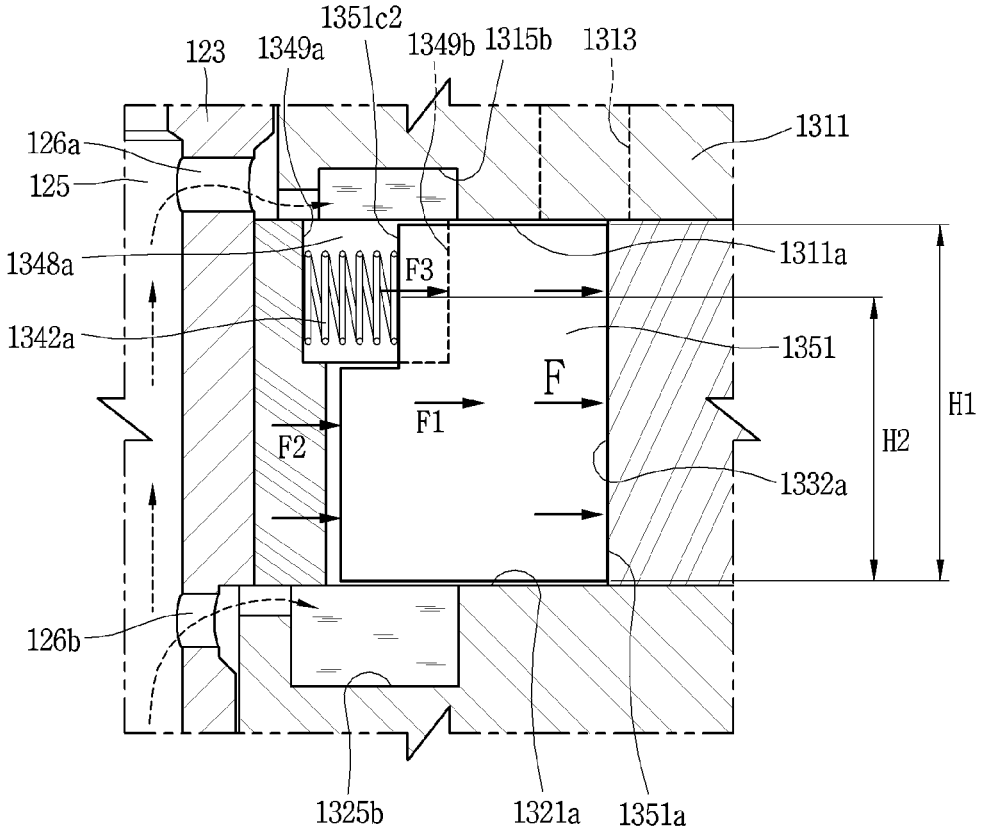
FIG. 10 is a cross-sectional view illustrating a support state of a vane near a contact point in FIG. 8.

FIGS. 9A and 9B are enlarged schematic views illustrating a support state of a vane for each position in FIG. 8, where FIG. 9A illustrates a remote portion section and FIG. 9B illustrates a proximal portion section. FIG. 10 is a cross-sectional view illustrating a support state of a vane near a contact point in FIG. 8.

First, when the compressor is stopped, the first vane spring 1342*a* may be kept in a fixed initial state in a such manner that the first end 1342*a*1 of the first vane spring 1342*a* is in close contact with the first spring fixing surface 1349*a* of the first spring insertion groove 1348*a* and the second end 1342*a*2 of the first vane spring 1342*a* is in close contact with the second spring fixing surface 1349*b* of the first spring insertion groove 1348*a*. Accordingly, the first vane spring 1342*a* may be maintained in its initial state without being separated from the first spring insertion groove 1348*a*.

Next, during operation of the compressor, the second end 1342*a*2 of the first vane spring 1342*a* may be kept in close contact with the second spring fixing surface 1349*b* of the first spring insertion groove 1348*a* or brought into contact with the rear surface 1351*b* of the first vane 1351 so as to elastically support the first vane 1351 such that the first vane may be pressed toward the inner circumferential surface 1332 of the cylinder 133, depending on the position of the first vane 1351. More specifically, as illustrated in FIGS. 8 and 9A, when the first vane 1351 passes through the remote portion 1332*b* and the curved portion 1332*c* defining the first section α1, the first vane 1351 may be pushed away from the rotational center Or of the roller 134. Then, the rear surface 1351*b* of the first vane 1351, more precisely, the first spring support portion 1351*c* may be hidden in the first vane slot 1346*a*. The first end 1342*a*1 of the first vane spring 1342*a* may then be maintained in its initial state in close contact with the second spring fixing surface 1349*b* of the first spring insertion groove 1348*a*.

On the other hand, as illustrated in FIGS. 8 and 9B, when the first vane 1351 passes through the proximal portion 1332*c* defining the second section α2, the first vane 1351 may be pushed toward the rotational center Or of the roller 134. Then, the first spring support portion 1351*c* disposed on the rear surface 1351*b* of the first vane 1351 may be pushed out of the first vane slot 1346*a*, that is, to the inside of the first spring insertion groove 1348*a*. The second support surface 1351*c*2 of the first spring support portion 1351*c* may then come into contact with the second end 1342*a*2 of the first vane spring 1342*a*.

Referring to FIG. 10, as the first vane 1351 gets closer to the contact point P, the first vane 1351 may gradually be closer to the rotational center Or of the roller 134, and the second end 1342*a*2 of the first vane spring 1342*a* may transfer the elastic force F3 to the first vane 1351 in a state of being spaced apart from the second spring fixing surface 1349*b* of the first spring insertion groove 1348*a*. Then, the first vane 1351 may be pushed toward the inner circumferential surface 1332 of the cylinder 133 by receiving the pressing force F which is the sum of the centrifugal force F1, the back pressure F2, and the elastic force F3 of the first vane spring 1342*a*.

As described above, the configuration of the first vane 1351, the first spring insertion groove 1348*a*, and the first vane spring 1342*a* may be the same as the configurations of the second vane 1352 and the third vane 1353, the second spring insertion groove 1348*b* and the third spring insertion groove 1348*c*, and the second vane spring 1342*b* and the third vane spring 1342*c*, respectively. Accordingly, when the second vane 1352 and the third vane 1353 also pass through the second section α2, they may be elastically supported toward the inner circumferential surface of the cylinder 133 by the second vane spring 1342*b* and the third vane spring 1342*c*.

In this way, in the vane rotary compressor according to this embodiment, as the elastic force is additionally applied to the rear surface of the vanes in addition to the back pressure, trembling of the vane that occurs while the vane passes through the proximal portion may be suppressed or prevented. In particular, the trembling of the vane may be more severe when the compressor is initially started, but this may be effectively suppressed or prevented to prevent an initial start failure and increase compressor efficiency. In addition, when it is applied to an air conditioner, cooling and heating effects may be quickly exhibited and reliability may be increased accordingly.

In the vane rotary compressor according to this embodiment, the trembling of the vane in the vicinity of the contact point may also be suppressed or prevented, thereby preventing wear of the inner circumferential surface of the cylinder or the front surface of the vane in the vicinity of the contact point. This may reduce vibration noise around the contact point and simultaneously prevent leakage between compression chambers, thereby enhancing the compressor efficiency.

In the vane rotary compressor according to this embodiment, pressing force exerted on the vane may be more uniform by the elastic force applied to the rear surface of the vane. This may more effectively suppress or prevent the trembling of the vane. In addition, as the elastic force using the vane spring as well as the back pressure using oil is applied to the rear surface of the vane, the burden on the back pressure may be reduced, thereby simplifying a back pressure structure for supplying oil to the rear surface of the vane. Those effects described above may be more expected in the rotary compressor according to this embodiment when a high-pressure refrigerant such as R32, R410a, or $CO_2$ is used.

Hereinafter, description will be given of a vane support structure according to another embodiment. That is, in the previous embodiment, the spring support portion is formed to be less than half the height of the vane in the axial direction, but in some cases, the spring support portion may be formed to be more than half the height of the vane in the axial direction.

Figure 11:
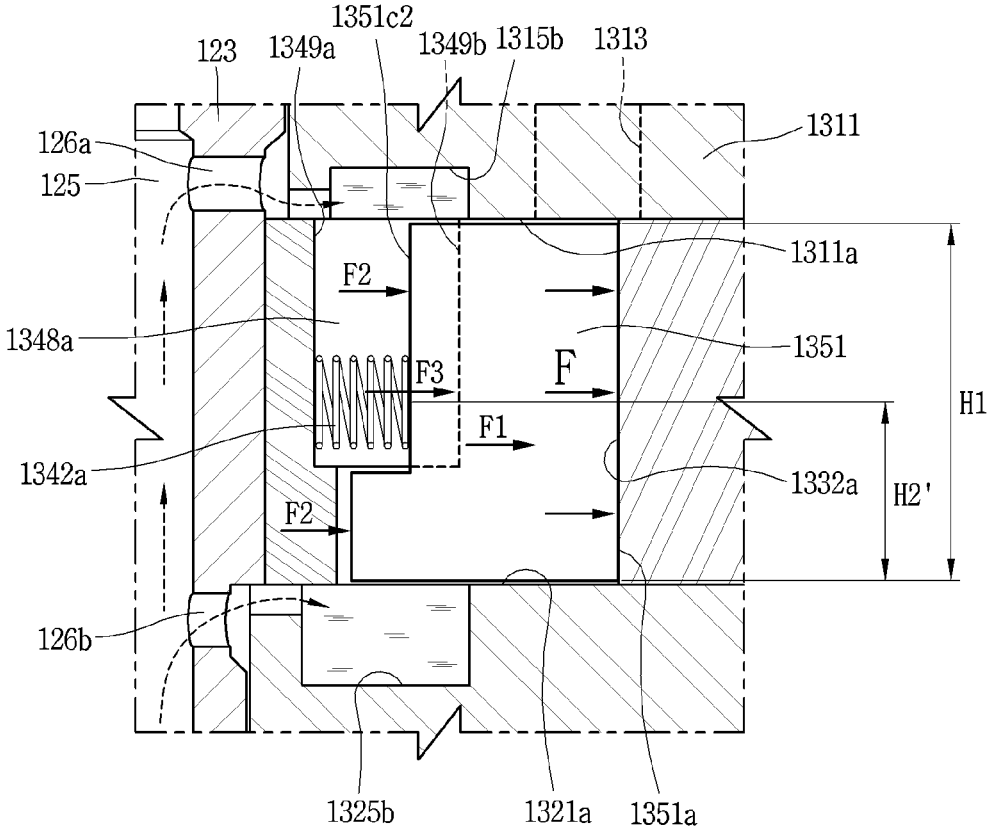
FIG. 11 is a cross-sectional view of a vane support structure in FIG. 4 according to another embodiment.
Figure 12:
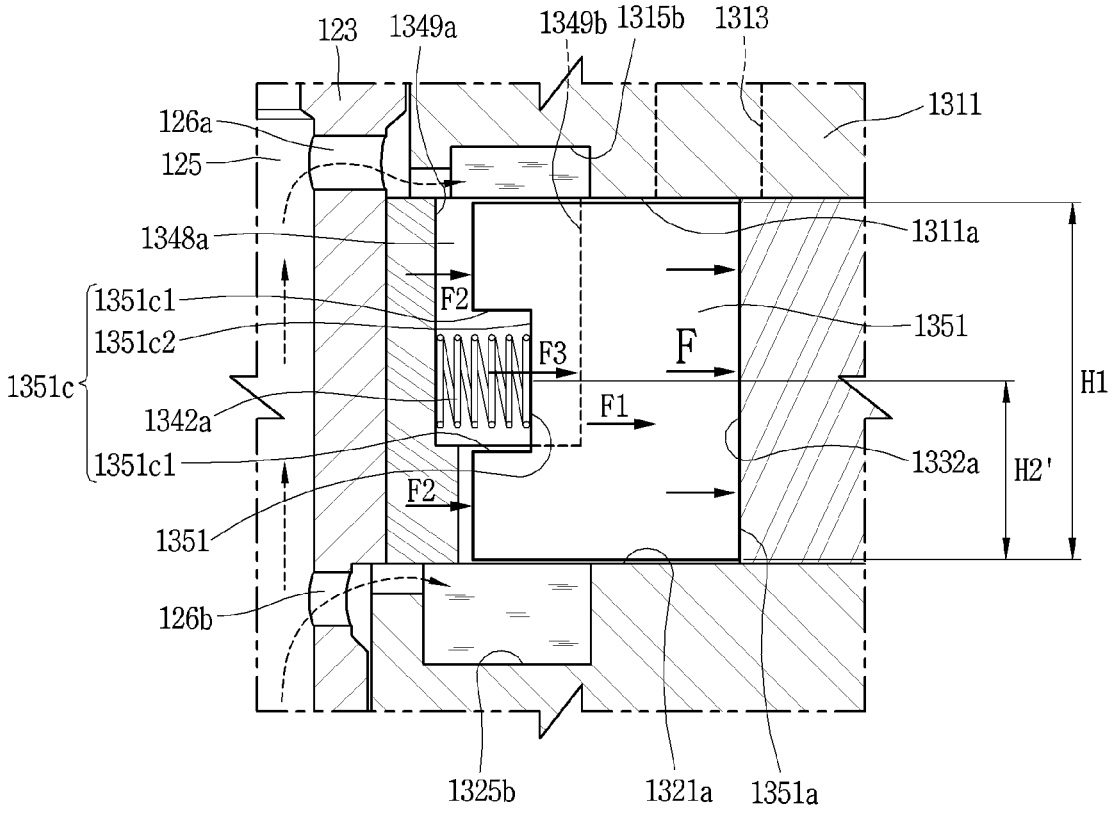
FIG. 12 is a cross-sectional view of a vane support structure in FIG. 4 according to still another embodiment.

FIG. 11 is a cross-sectional view of a vane support structure in FIG. 4 according to another embodiment. FIG. 12 is a cross-sectional view of a vane support structure in FIG. 4 according to still another embodiment.

Referring to FIG. 11, the basic configuration of the roller 134 including the first vane slot 1346*a* and the first spring insertion groove 1348*a*, the first vane 1351 including the first spring support portion 1351*c*, and the first vane spring 1342*a* according to this embodiment, and operating effects obtained may be almost the same as those of the previous embodiment. In other words, the first spring insertion groove 1348*a* may be formed in the upper surface of the roller 134 to communicate with the first vane slot 1346*a*. The first spring support portion 1351*c* may be stepped on an upper edge of the rear surface 1351*b* of the first vane 1351. The first vane spring 1342*a* may be configured as the compression coil spring and may be kept inserted in the first spring insertion groove 1348*a* in the first section α1 or support the first spring support portion 1351*c* to press the first vane 1351 toward the cylinder 133 in the second section α2.

However, in this embodiment, the axial depth L23 of the first spring insertion groove 1348*a* may be greater than or equal to ½ of the axial height H1 of the roller 134, and the axial depth L42 of the first spring support portion 1351*c* may be greater than or equal to ½ of the axial height H1 of the first vane 1351. As the axial height H1 of the roller 134 and the axial height H1 of the first vane 1351 are almost the same, the axial depth L23 of the first spring insertion groove 1348*a* and the axial depth L42 of the first spring support portion 1351*c* may be defined based on the same reference, namely, the axial height H1 of the roller 134 or the axial height H1 of the first vane 1351.

For example, the axial depth L23 of the first spring insertion groove 1348*a* may be recessed into the upper surface of the roller 134 by more than half the axial height H1 of the roller 134, for example, by about ⅔ of the axial height H1 of the roller 134. In this case, the axial depth L42 of the first spring support portion 1351*c* may be greater than or equal to that of the first spring insertion groove 1348*a*. In other words, the first spring support portion 1351*c* may be formed on the upper edge of the rear surface 1351*b* of the first vane 1351, and the second support surface 1351*c*2 may be recessed into the upper surface of the first vane 1351 by more than half the vane 1351, for example, by about ⅔ in the axial direction.

As described above, when the first spring insertion groove 1348*a* or/and the first spring support portion 1351*c* is/are formed to be at least half of the axial height H1 of the roller 134 or/and the first vane 1351, the first vane spring 1342*a* may be located to be close to an intermediate height of the roller 134 in the axial direction. For example, as illustrated in FIG. 11, the first spring insertion groove 1348*a* or/and the first spring support portion 1351*c* is/are formed to be ⅔ of the axial height H1 of the roller 134 or/and the first vane 1351, an axial height H2' of the first vane spring 1342*a* may be located at an intermediate position of the first vane 1351, that is, at an intermediate height of the first vane 1351 in the axial direction.

Then, the elastic force F3 generated by the first vane spring 1342*a* may be uniformly applied along the axial direction of the first vane 1351, which may allow securing of a constant pressing force F applied to the first vane 1351 such that the first vane 1351 may be pushed toward the inner circumferential surface 1332 of the cylinder 133. With this configuration, the surface pressure may be constantly maintained between the front surface 1351*a* of the first vane 1351 and the inner circumferential surface 1332 of the cylinder 133 facing the front surface 1351*a*, thereby suppressing or preventing uneven friction or uneven wear of the first vane 1351 or/and the cylinder 133.

The first spring support portion 1351*c* may alternatively be formed in a groove shape in the rear surface 1351*b* of the first vane 1351. For example, as illustrated in FIG. 12, the first spring support portion 1351*c* may be recessed into the rear surface 1351*b* of the first vane 1351 by a preset or predetermined depth in a direction toward the front surface 1351*a*.

In this case, the first spring support portion 1351*c* may have first support surfaces 1351*c*1 formed on both sides of the second support surface 1351*c*2 in the axial direction. Accordingly, the second end 1342*a*2 of the first vane spring 1351 may be supported in the slot direction by the second support surface 1351*c*2 of the first spring support portion 1351*c* and at the same time both sides of the outer circumferential surface of the second end 1342*a*2 of the first vane spring 1351 in the axial direction may be supported by the first support surfaces 1351*c*1 of the first spring support portion 1351*c*. This may result in stably supporting the second end 1342*a*2 of the first vane spring 1351 in the axial direction.

As described above, even when the first spring support portion 1351*c* is recessed into a rectangular or tapered shape in the rear surface 1351*b* of the first vane 1351, the first spring support portion 1351*c* may be formed to be eccentric toward a side adjacent to the discharge port 1313, as illustrated in FIG. 7, or may be formed at an intermediate height of the rear surface 1351*b* of the first vane 1351 as illustrated in FIG. 11. The operating effects thereof may be the same as those described with reference to FIGS. 7 and 11.

Hereinafter, description will be given of a vane support structure according to still another embodiment. That is, the previous embodiments illustrate that the spring insertion groove is open, but in some cases, at least a portion of the spring insertion groove may be closed.

Figure 13:
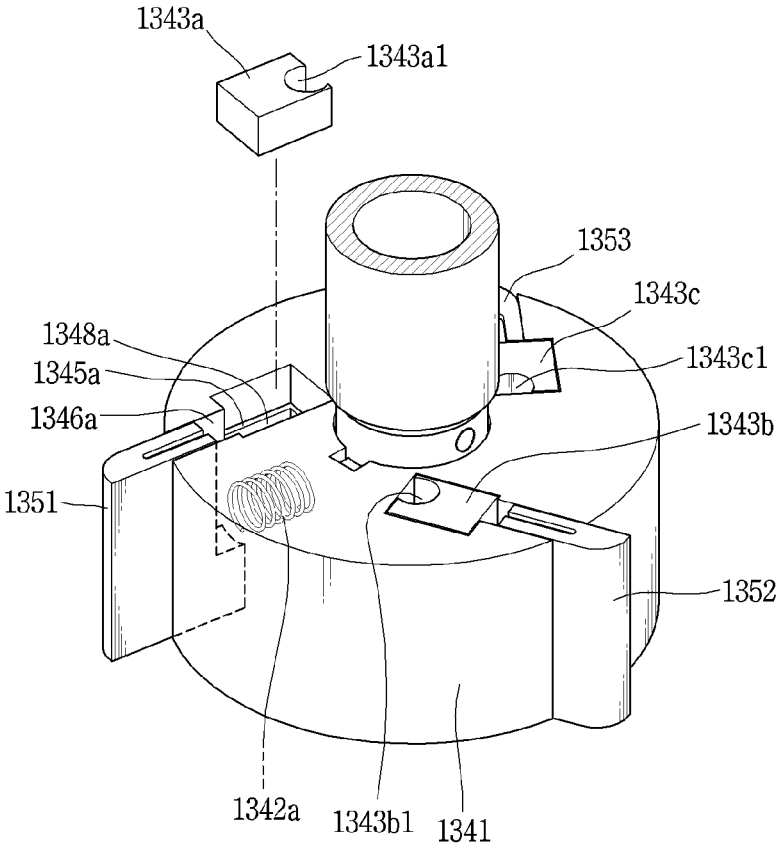
FIG. 13 is an exploded perspective view of a vane support structure in FIG. 4 according to still another embodiment.
Figure 14:
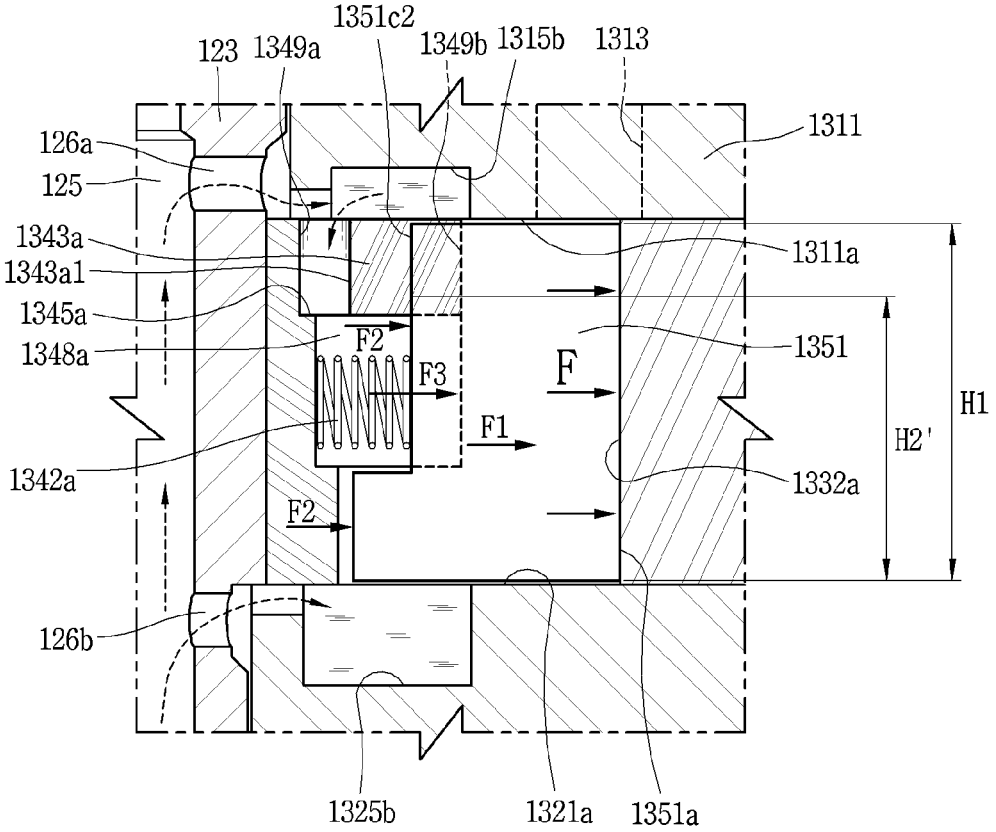
FIG. 14 is an enlarged sectional view of the vane support structure in FIG. 13.

FIG. 13 is an exploded perspective view of a vane support structure in FIG. 4 according to another embodiment. FIG. 14 is an enlarged sectional view of the vane support structure in FIG. 13.

Referring to FIGS. 13 and 14, the basic configuration of the roller 134 including the first vane slot 1346*a* and the first spring insertion groove 1348*a*, the first vane 1351 including the first spring support portion 1351*c*, and the first vane spring 1342*a* according to this embodiment, and the operating effects obtained may be almost the same as those of the previous embodiment. For example, the axial depth L42 of the first spring insertion groove 1348*a* and the first spring support portion 1351*c* may be formed in the same manner as in the embodiment of FIG. 11.

In this case, a wide gap may be generated between the first vane spring 1342*a* and the main sliding surface 1311*a* of the main bearing 131 facing it in the axial direction, which may cause the first vane spring 1342*a* to be twisted in the process of expansion and contraction. When the first vane spring 1342*a* is greatly twisted while being expanded or contracted, the elastic force F3 of the first vane spring 1342*a* transmitted to the first vane 1351 may not be constantly maintained and thereby the surface pressure between the first vane 1351 and the cylinder 133 may become non-uniform. Then, wear may be increased on the front surface 1351*a* of the first vane 1351 and/or the inner circumferential surface 1332 of the cylinder 133.

Accordingly, in this embodiment, a first cover member (cover or stopper) 1343*a* may be disposed on an upper end of the first spring insertion groove 1348*a*, that is, on an upper side of the first vane spring 1342*a* in a state in which the first vane spring 1342*a* is inserted. For example, a first cover insertion groove 1345*a* may be stepped on the upper end of the first spring insertion groove 1348*a*, and the first cover member 1343*a* may be fixedly inserted into the first cover insertion groove 1345*a*.

The first cover member 1343*a* may be configured as a kind of groove stopper or a spring stopper, and may be, for example, press-fitted or screwed into the upper end of the first spring insertion groove 1348*a*. In this embodiment, an example in which the first cover member 1343*a* is press-fitted into the first spring insertion groove 1348*a* is illustrated.

The first cover member 1343*a* may be formed in the same shape in the axial direction as the first spring insertion groove 1348*a*, namely, a rectangular parallelepiped shape, so as to be press-fitted into the first spring insertion groove 1348*a*. Accordingly, an outer circumferential surface of the first cover member 1343*a* and an inner circumferential surface of the first spring insertion groove 1348*a* facing it may be in close contact with each other along the circumference.

However, the outer circumferential surface of the first cover member 1343*a* and the inner circumferential surface of the first spring insertion groove 1348*a* facing it may be at least partially spaced apart from each other along the circumference. For example, an area of the first cover member 1343*a* may be smaller than an area of the first spring insertion groove 1348*a*. Accordingly, a first oil passage 1343*a*1 may be formed between the outer circumferential surface of the first cover member 1343*a* and the inner circumferential surface of the first spring insertion groove 1348*a* facing it.

The first oil passage 1343*a*1 may communicate with the first main back pressure pocket 1315*a* or the second main back pressure pocket 1315*b*. Accordingly, oil accommodated in the first main back pressure pocket 1315*a* or the second main back pressure pocket 1315*b* may be introduced into the first spring insertion groove 1348*a* through the first oil passage 1343*a*1. In the drawings, reference numerals 1345*b* and 1345*c* denote second and third cover members, and 1343*b*1 and 1343*c*1 denote second and third oil passages, respectively.

When the first cover member 1343*a* is coupled to the upper end of the first spring insertion groove 1348*a* as described above, deformation of the first vane spring 1342*a* which occurs during expansion and contraction may be prevented. Accordingly, the elastic force F3 applied to the first vane 1351 may be uniformly maintained, so that the surface pressure between the first vane 1351 and the cylinder 133 may be constant in the axial direction.

In addition, as the first spring insertion groove 1348*a* is covered with the first cover member 1343*a* in a state in which the first vane spring 1342*a* is inserted into the first spring insertion groove 1348*a*, the first vane spring 1342*a* may be prevented from being separated from the first spring insertion groove 1348*a*. Accordingly, it may not be necessary that both ends of the first vane spring 1342*a* are excessively in close contact with the first spring fixing surface 1349*a* and the second spring fixing surface 1349*b* of the first spring insertion groove 1348*a* when the first vane spring 1342*a* is inserted into the first spring insertion groove 1348*a*. This may prevent separation of the first vane spring 1342*a* and also simplify assembly of the first vane spring 1342*a*.

Although not illustrated, one cover insertion groove (not illustrated) that includes a plurality of spring insertion grooves 1348*a* may be formed in an annular shape in the upper surface of the roller 134, and one cover member (not illustrated) may be inserted into the cover insertion groove so as to cover all of the plurality of spring insertion grooves. In this case, the basic effects of the cover member described above may be obtained, and additionally the assembly of the cover member may be simplified so as to reduce manufacturing costs of the cover member.

Hereinafter, description will be given of a roller according to another embodiment. That is, the previous embodiments illustrate that the roller is formed as a single body, but in some cases, the roller may include a plurality of roller bodies. In this case, the first spring insertion groove 1348*a* may be formed in either one of the roller bodies, or may be partially formed in both roller bodies. This embodiment will be described based on an example in which the roller includes a plurality of roller bodies but the first spring insertion groove 1348*a* are partially formed in the roller bodies, respectively.

Figure 15:
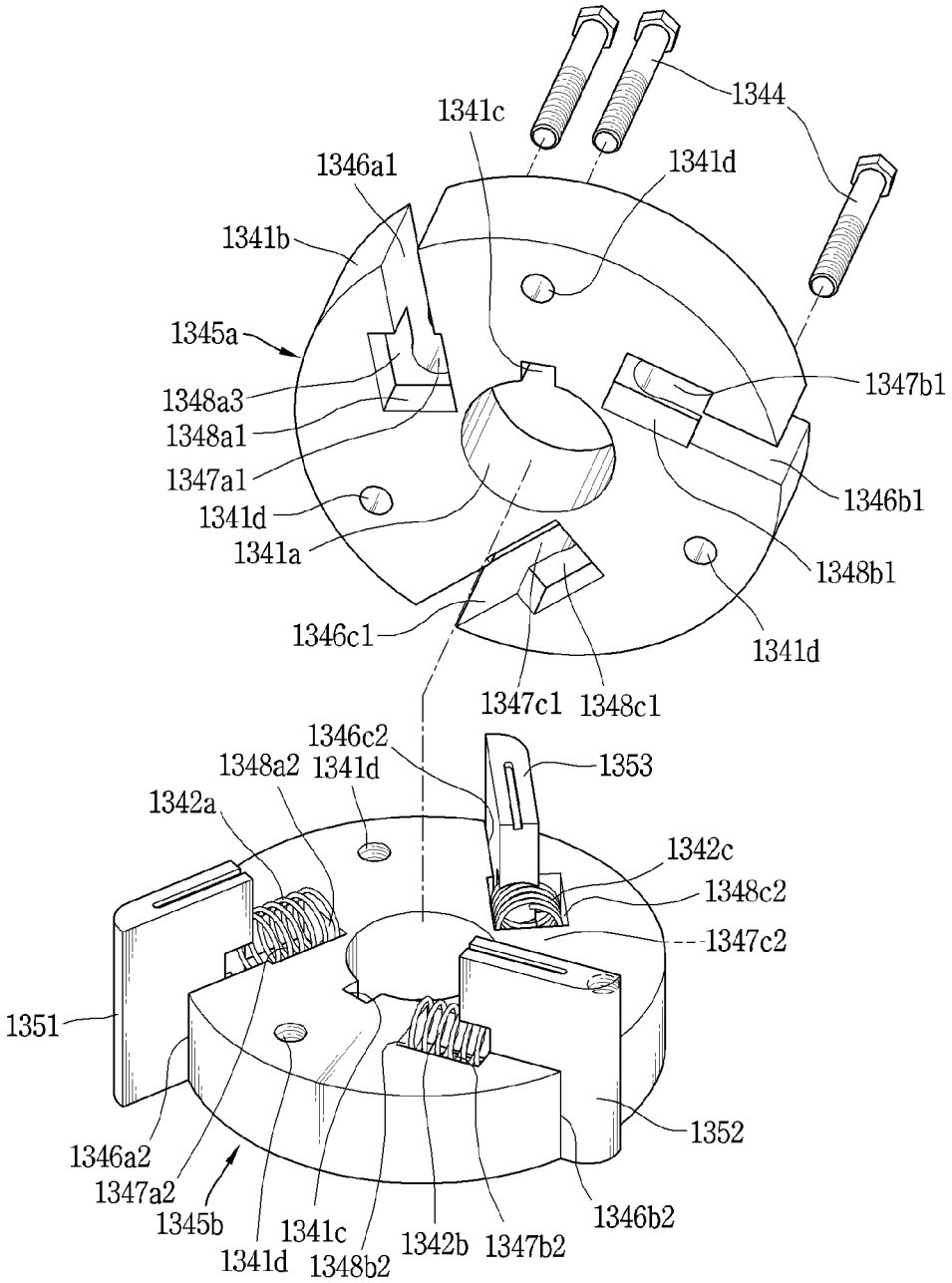
FIG. 15 is an exploded perspective view of a roller in FIG. 1 according to another embodiment.
Figure 16:
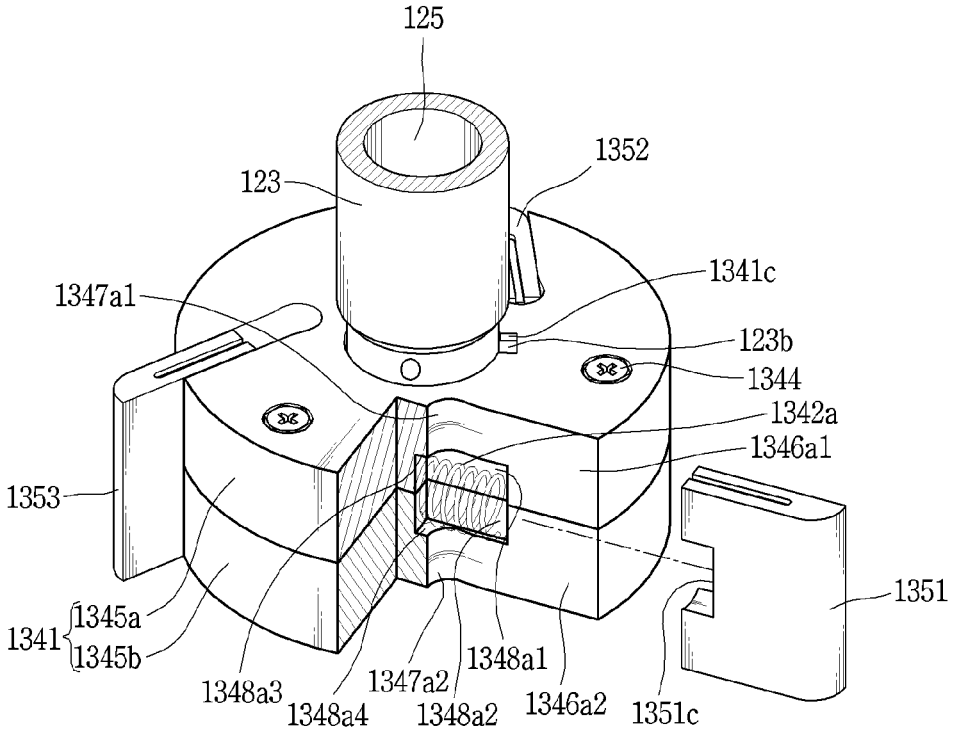
FIG. 16 is an assembled perspective view of the roller in FIG. 15.
Figure 17:
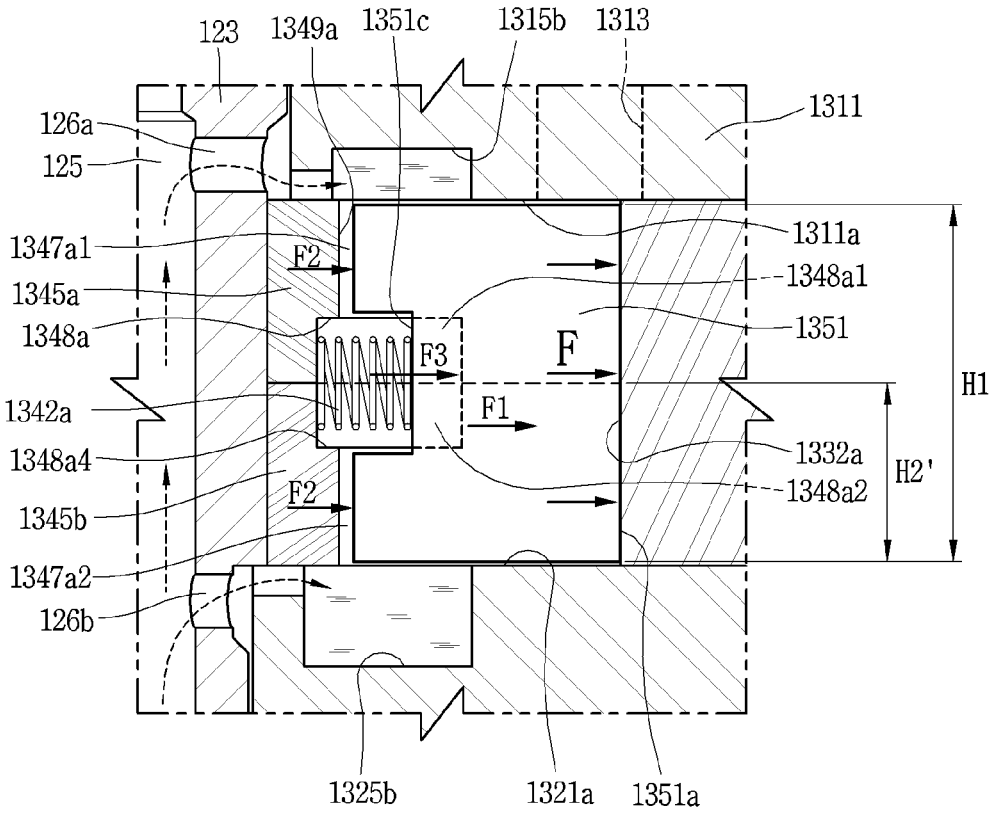
FIG. 17 is an enlarged sectional view of the vane support structure in FIG. 16.

FIG. 15 is an exploded perspective view of a roller in FIG. 1 according to another embodiment. FIG. 16 is an assembled perspective view of the roller in FIG. 15. FIG. 17 is an enlarged sectional view of the vane support structure in FIG. 16.

Referring to FIGS. 15 to 17, the compression unit 130 according to this embodiment may be similar to the compression units 130 in the previous embodiments. For example, the compression unit 130 may include main bearing 131, sub bearing 132, cylinder 133, roller 134, and a plurality of vanes 1351, 1352, and 1353, and the roller 134 may include roller bodies 1341 and a plurality of vane springs 1342*a*, 1342*b*, and 1342*c*. The main bearing 131, sub bearing 132, cylinder 133, roller 134, and vanes 1351, 1352, and 1353 may be similar to those in the previous embodiments.

However, the roller 134 according to this embodiment may include a plurality of roller bodies 1341, for example, first roller body 1345*a* and second roller body 1345*b*. The first roller body 1345*a* may be located at an upper side adjacent to the drive motor 120 in the axial direction, and the second roller body 1345*b* may be located at a lower side of the first roller body 1345*a*.

The first roller body 1345*a* and the second roller body 1345*b* may be, for example, fastened with bolts to form the single roller 134. For example, the first roller body 1345*a* and the second roller body 1345*b* may have at least one fastening hole 1341*d*, more specifically, one fastening hole 1341*d* formed between adjacent vane slots 1346*a*, 1346*b*, and 1346*c* and may be fastened to each other with fastening bolts 1344.

An axial height of the first roller body 1345*a* and an axial height of the second roller body 1345*b* may be equal to each other. Accordingly, the first vane spring 1342*a* may be disposed at an intermediate height of the roller bodies 1341.

Although not illustrated, the axial height of the first roller body 1345*a* and the axial height of the second roller body 1345*b* may be different from each other. In this case, the spring insertion groove 1348*a* may be formed in one of the first roller body 1345*a* or the second roller body 1345*b*, and the other body may be formed in a flat plate shape.

The first roller body 1345*a* and the second roller body 1345*b* may be formed symmetrically with respect to axial side surfaces facing each other. For example, the first roller body 1345*a* may include a first roller-side slot 1346*a*1 defining a (first) portion of the first vane slot 1346*a*, a first roller-side chamber 1347*a*1 defining a (first) portion of the first back pressure chamber 1347*a*, and a first roller-side insertion groove 1348*a*1 defining a (first) portion of the first spring insertion groove 1348*a*. The second roller body 1345*b* may include a second roller-side slot 1346*a*2 defining another (second) portion of the first vane slot 1346*a*, a second roller-side chamber 1347*a*2 defining another (second) portion of the first back pressure chamber 1347*a*, and a second roller-side insertion groove 1348*a*2 defining another (second) portion of the first spring insertion groove 1348*a*.

In this case, the first roller-side slot 1346*a*1 and the second roller-side slot 1346*a*1 may be symmetrical to each other on a same axis, and the first roller-side chamber 1347*a*1 and the second roller-side chamber 1347*a*2 may be symmetrical to each other on the same axis. Also, the first roller-side insertion groove 1348*a*1 and the second roller-side insertion groove 1348*a*2 may be symmetrical to each other on the same axis. Accordingly, when the first roller body 1345*a* and the second roller body 1345*b* are coupled to each other, the first vane slot 1346*a*, the first back pressure chamber 1347*a*, and the first spring insertion groove 1348*a* may be provided one by one. Of course, even in this case, the second vane slot 1346*b* and the third vane slot 1346*c*, the second back pressure chamber 1347*b* and the third back pressure chamber 1347*c*, and the second spring insertion groove 1348*b* and the third spring insertion groove may be provided one by one.

The first vane slot 1346*a* and the first back pressure chamber 1347*a* may be similar to the first vane slot 1346*a* and the first back pressure chamber 1347*a* in the previous embodiments. For example, the first vane slot 1346*a* may be inclined by a predetermined inclination angle with respect to the radial direction, and the first back pressure chamber 1347*a* may be formed to communicate with the rear end portion of the first vane slot 1346*a*.

The first vane slot 1346*a* and the first back pressure chamber 1347*a* may be formed in a penetrating manner in the axial direction, respectively. However, in the previous embodiments, as the first spring insertion groove 1348*a* is formed in one (first) side surface of the roller 134 in the axial direction, the first back pressure chamber 1347*a* is formed to be eccentric to another (second) side surface of the roller 134 in the axial direction where the first spring insertion groove 1348*a* is not formed. However, in this embodiment, the first spring insertion groove 1348*a* may be formed at the intermediate height of the roller 134, such that the first back pressure chamber 1347*a* may be formed in each of both side surfaces of the roller 134 in the axial direction.

As described above, the first spring insertion groove 1348*a* may be formed at the intermediate height of the roller 134, that is, an intermediate height of the first back pressure chamber 1347*a*. For example, the first spring insertion groove 1348*a* may include a first roller-side insertion groove 1348*a*1 formed in the first roller body 1345*a*, and a second roller-side insertion groove 1348*a*2 formed in the second roller body 1345*b*.

The first roller-side insertion groove 1348*a*1 may be recessed by a preset or predetermined depth in the axial direction from a lower surface to an upper surface of the first roller body 1345*a*, and the second roller-side insertion groove 1348*a*2 may be recessed by a preset or predetermined depth in the axial direction from an upper surface to a lower surface of the second roller body 1345*b*. Accordingly, a lower end of the first roller-side insertion groove 1348*a*1 and an upper end of the second roller-side insertion groove 1348*a*2 facing it may be open. On the other hand, a first roller-side stepped surface 1348*a*3 may be formed on an upper end of the first roller-side insertion groove 1348*a*1 and a second roller-side stepped surface 1348*a*4 may be formed on a lower end of the second roller-side insertion groove 1348*a*2 opposite to the upper end of the first roller-side insertion groove 1348*a*1. The first roller-side stepped surface 1348*a*3 and the second roller-side stepped surface 1348*a*4 may communicate with the first roller-side chamber 1347*a*1 and the second roller-side chamber 1347*a*2, respectively.

As described above, even when the roller body 1341 is formed by post-assembling the first roller body 1345*a* and the second roller body 1345*b* separable from each other, the operating effects may be similar to those of the previous embodiments. However, in this embodiment, as the first vane spring 1342*a* is inserted between the first roller main body 1345*a* and the second roller body 1345*b* disposed on both sides in the axial direction, the first vane spring 1342*a* may be easily disposed in the middle of the roller 134 in the axial direction.

In this embodiment, as the first roller-side stepped surface 1348*a*3 and the second roller-side stepped surface 1348*a*4 are formed on the upper end of the first roller-side insertion groove 1348*a*1 and the lower end of the second roller-side insertion groove 1348*a*2, respectively, the first vane spring 1342*a* inserted in the first spring insertion groove 1348*a* may be restricted from being deformed in the axial direction. With the configuration, there is no need to separately assemble the plurality of cover members 1343*a*, 1343*b*, and 1343*c* as in the embodiment of FIG. 13, so that the roller may be easily manufactured even when the roller 134 is formed by assembling the plurality of separable parts.

In this embodiment, the first roller body 1345*a* and the second roller body 1345*b* may be axially symmetrical to each other in a state in which the first spring insertion groove 1348*a* is located in the middle of the roller 134. Accordingly, a center of gravity of the roller 134 may be located at the rotational center Or of the roller 134. This may reduce vibration of a rotating body including the roller 134 during operation of the compressor so as to decrease friction loss or wear and simultaneously reduce leakage of refrigerant, thereby enhancing compressor performance.

Hereinafter, description will be given of a vane support structure according to still another embodiment. That is, the previous embodiments illustrate that the back pressure pockets are provided in both bearings, but in some cases, the back pressure pockets may be excluded from the both bearings. In this case, the inner circumferential surface of the cylinder may be formed in a circular or non-circular shape, for example, an asymmetric elliptical shape, but in this embodiment, a circular cylinder will be described as an example.

Figure 18:
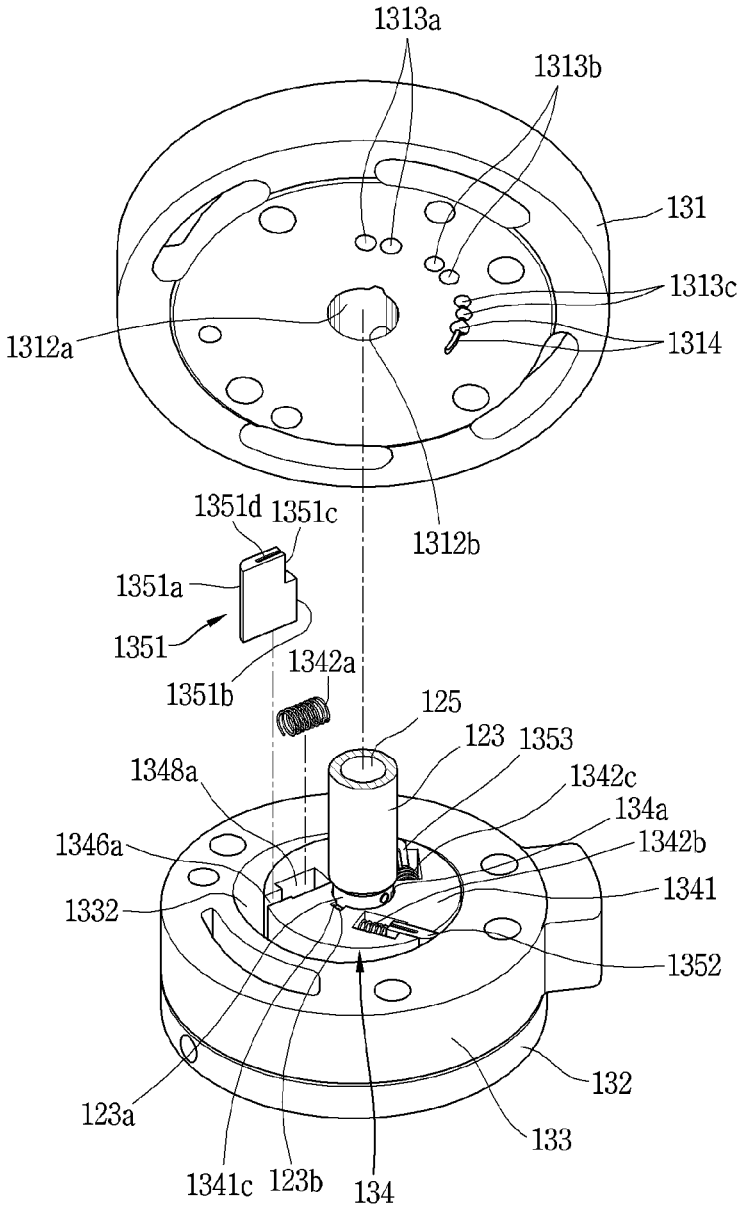
FIG. 18 is an exploded perspective view of the compression unit in FIG. 1 according to another embodiment.
Figure 19:
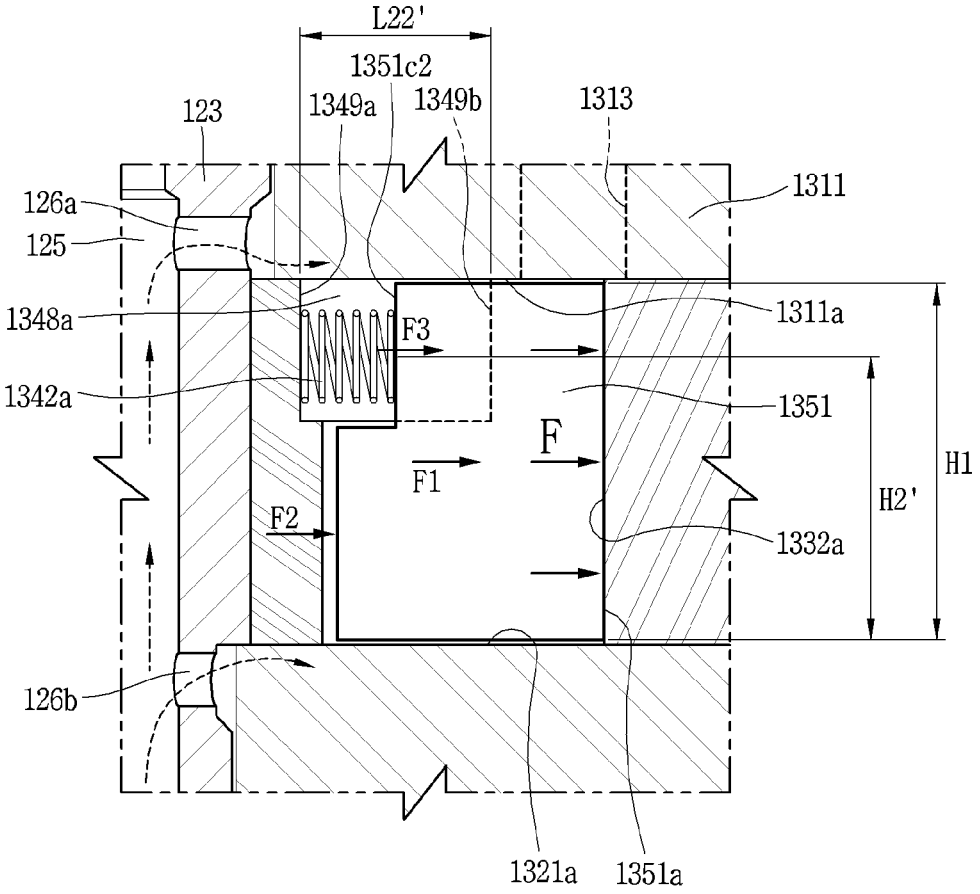
FIG. 19 is a cross-sectional view of a vane support structure in FIG. 18 according to another embodiment.
Figure 20:
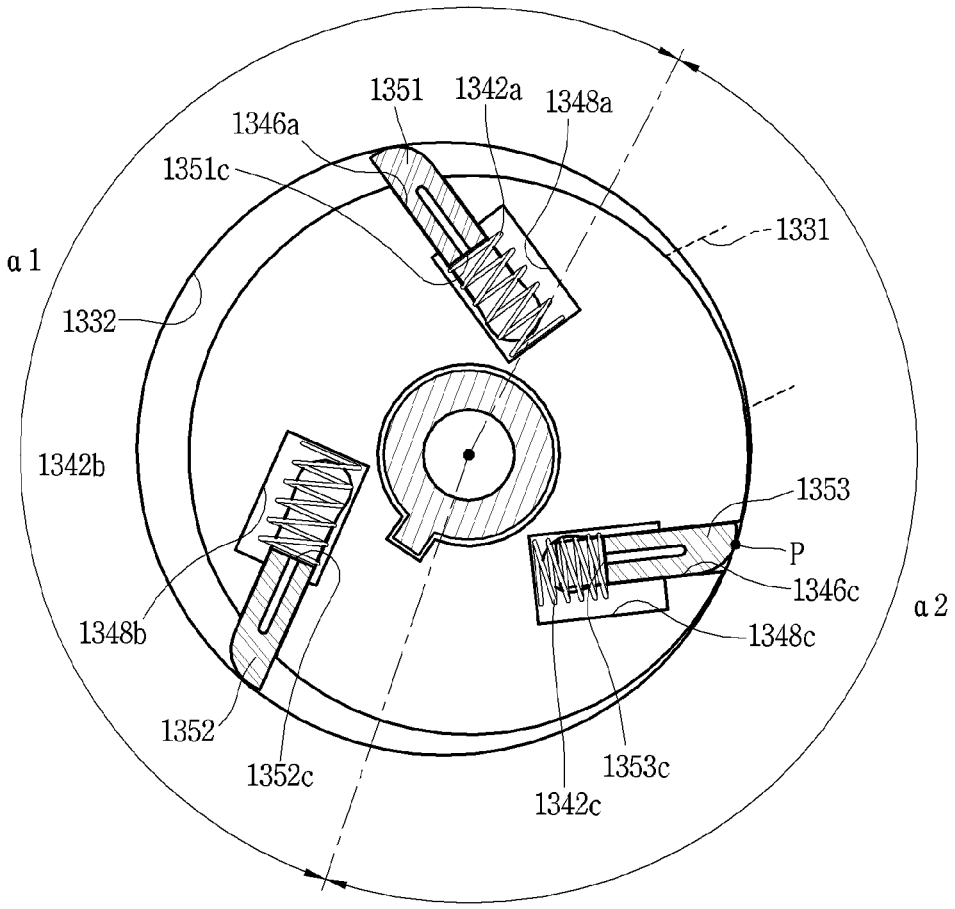
FIG. 20 is a schematic view illustrating a relationship with a vane spring according to a position of a vane in FIG. 18.
Figure 21A:
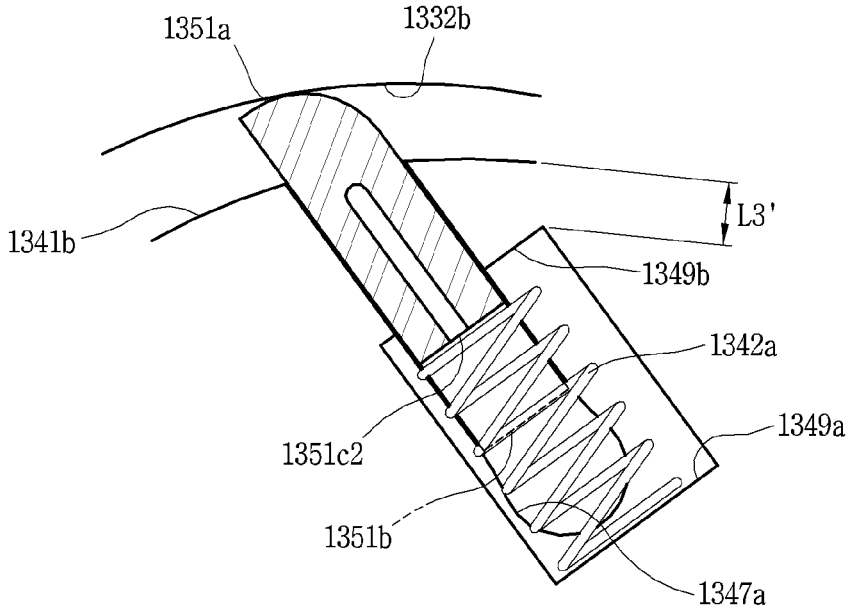
FIGS. 21A and 21B are enlarged schematic views illustrating a support state of a vane for each position in FIG. 20, where
Figure 21B:
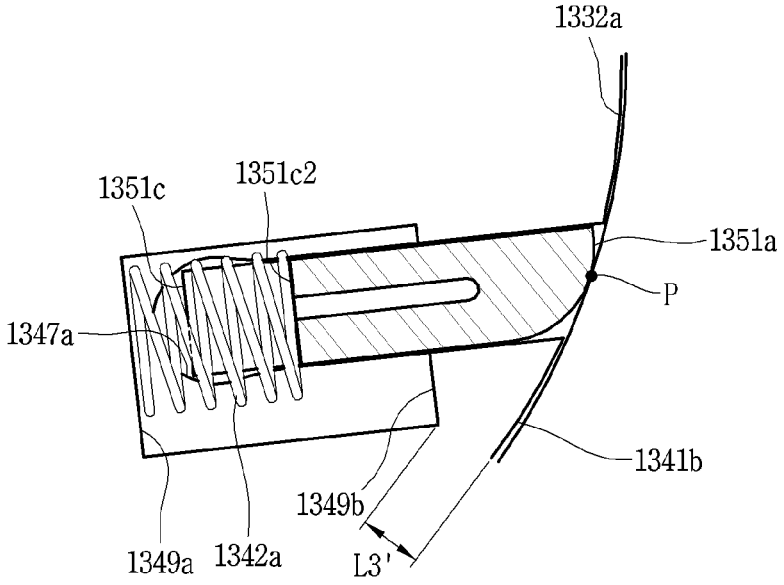

FIG. 19 is a cross-sectional view of a vane support structure in FIG. 18 according to still another embodiment. FIG. 20 is a schematic view illustrating a relationship with a vane spring according to a position of a vane in FIG. 18. FIG. 21A is a schematic view illustrating a support state of a vane passing through a first section, and FIG. 21B is a schematic view illustrating a support state of a vane passing through a second section.

Referring to FIGS. 19 to 21B, the compression unit 130 according to this embodiment may be similar to the compression unit 130 in the previous embodiments. For example, the compression unit 130 may include main bearing 131, sub bearing 132, cylinder 133, roller 134, and a plurality of vanes 1351, 1352, and 1353, and the roller 134 may include roller bodies 1341 and a plurality of vane springs 1342*a*, 1342*b*, and 1342*c*. The main bearing 131, sub bearing 132, cylinder 133, roller 134, and vanes 1351, 1352, and 1353 may be similar to those in the previous embodiments. Also, the overall structure of the roller body 1341 constituting the roller 134 and the vane springs 1342*a*, 1342*b*, and 91342*c* and the operating effects thereof may be similar to those of the previous embodiments, and the vanes 1351, 1352, and 1353 may also have similar structure and operating effects to those in the previous embodiments. In this regard, the first vane 1351 and portions related thereto will be described as follows.

However, in the roller body 1341 according to this embodiment, the slot-direction length L22' of the first spring insertion groove 1348*a* (the same as the slot-direction distance between the spring fixing surfaces) and the free state length of the first vane spring 1342*a* may be longer than those in the previous embodiments. In other words, in the previous embodiments, the rear end of the first vane 1351, precisely, the first spring support portion 1351*c* may be hidden in the first vane slot 1346*a* in the first section α1 of the cylinder 133 so as not to be exposed to the first spring insertion groove 1348*a*. Therefore, the first vane 1351 may be separated from the first vane spring 1342*a* in the first section α1.

However, in this embodiment, the slot-direction length L22' and the free state length of the first vane spring 1342*a* may extend such that the first vane 1351 may be exposed to the first spring insertion groove 1348*a* in the entire section of the cylinder 133 including the first section α1. In other words, even when the first vane 1351 passes through a section, this is, the first section α1, that protrudes from the first vane slot 1346*a* of the roller 134 to the maximum, the first spring support portion 1351*c* of the first vane 1351 may remain inside of the first spring insertion groove 1348*a*. Accordingly, even in the first section α1, the second end 1342*a*2 of the first vane spring 1342*a* may be brought into contact with the rear end of the first vane 1351, that is, the second support surface 1351*c*2 of the first spring support portion 1351*c*. Therefore, the first vane 1351 may be elastically supported by the first vane spring 1342*a* in the entire section of the cylinder 133.

As described above, when the first vane 1351 is elastically supported by the first vane spring 1342*a* in the entire section of the cylinder 133, a back pressure does not have to be applied to the first vane 1351 or the necessity of the back pressure may be lowered. Accordingly, back pressure pockets may not be formed or reduced in the main bearing 131 and the sub bearing 132 according to this embodiment. In other words, the entire main sliding surface 1311*a* of the main bearing 131 and the entire sub sliding surface 1321*a* of the sub bearing 1321 may be formed to be flat, respectively.

This may simplify processing of the main bearing 131 and the sub bearing 132, thereby reducing manufacturing costs. In addition, by removing or reducing the back pressure pockets and the back pressure chambers from the main bearing 131 and the sub bearing 132, a pressure pulsation that may occur in the back pressure pockets and the back pressure chambers may be removed or reduced, thereby stabilizing the behavior of the vane.

On the other hand, when the slot-direction length L22' of the first spring insertion groove 1348*a* extends as described above, it may be necessary to secure a minimum sealing distance between the first spring insertion groove 1348*a* and the outer circumferential surface of the roller 134. If an end, namely, the first spring fixing surface 1349*b* of the first spring insertion groove 1348*a* is excessively close to the outer circumferential surface of the roller 134, the sealing distance may be shortened and leakage between compression chambers through the first spring insertion groove 1348*a* may occur.

Considering this, it may be more advantageous when the inner circumferential surface 1332 of the cylinder 133 is circular rather than non-circular, as illustrated in FIG. 20. That is, the inner circumferential surface 1332 of the cylinder 133 according to this embodiment may be formed in a circular shape or may be formed in a non-circular shape, such as an asymmetric ellipse.

However, referring to FIGS. 21A and 21B, in a case in which the inner circumferential surface 1332 of the cylinder 133 is formed in a circular shape (hereinafter, a case of a circular shape), a maximum distance between the inner circumferential surface 1332 of the cylinder 133 and the outer circumferential surface 1341*b* of the roller 134 may be further shortened as compared to a case in which the inner circumferential surface 1332 of the cylinder 133 is formed in a non-circular shape (hereinafter, a case of a non-circular shape). As a result, when the inner circumferential surface 1332 of the cylinder 133 is formed in the circular shape, the slot-direction length L22' of the spring insertion groove 1348*a*, 1348*b*, 1348*c* may be relatively shortened and the vane 1351, 1352, 1353 may be elastically supported in the entire section of the cylinder 133 using the vane spring 1342*a*, 1342*b*, 1342*c* disposed in the roller 134, as compared to the case of the non-circular shape. This may facilitate securing of the sealing distance L3' when the inner circumferential surface 1332 of the cylinder 133 is circular, as compared to the case of the non-circular shape.

In other words, regardless of whether the inner circumferential surface 1332 of the cylinder 133 is circular or non-circular, the vane 1351, 1352, 1353 may be supported even without forming the back pressure pockets in the main bearing 131 and the sub bearing 132, but it may be more advantageous to apply this embodiment to the case of the circular shape in which a protrusion rate of the vane 1351, 1352, 1353 is relatively small.

Also, it may be more effective in the vane rotary compressor according to this embodiment when a high-pressure refrigerant, such as R32, R410a, or $CO_2$ is used. For example, when using a high-pressure refrigerant, a pressure difference with respect to a compression surface and a compression rear surface of each vane 1351, 1352, 1353 between the contact point P and the suction port 1331 may be generated more greatly in a case of using a high-pressure refrigerant than that in a case of using a medium/low refrigerant, such as R134a. Accordingly, when the high-pressure refrigerant is used, trembling of the vanes 1351, 1352, 1353 may increase between the contact point P and the suction port 1331, but as in this embodiment, the trembling of the vane 1351, 1352, 1353 may be effectively suppressed or prevented by increasing the pressing force applied to the vane in a corresponding section. As a result, leakage between compression chambers may be suppressed or prevented, and noise and wear due to trembling of the vane may be suppressed or prevented.

Also, although not illustrated, the vane spring 1342*a*, 1342*b*, 1342*c* may also be configured as a leaf spring in addition to the compression coil spring. For example, the vane spring 1342*a*, 1342*b*, 1342*c* may have a V-shaped cross-section, and may be inserted into the inner circumferential surface of the back pressure chamber 1347*a*, 1347*b*, 1347*c*. In this case, the bearing insertion groove 1348*a*, 1348*b*, 1348*c* having a slit shape may be formed in the inner circumferential surface of the back pressure chamber 1347*a*, 1347*b*, 1347*c*, and both axial ends of the vane spring 1342*a*, 1342*b*, 1342*c* having the V-shaped cross-section may be fixedly inserted into the bearing insertion groove 1348*a*, 1348*b*, 1348*c*. However, when the vane spring is configured as the leaf spring, it may be difficult to fixedly insert both axial ends of the small and thin vane spring 1342*a*, 1342*b*, 1342*c* into the narrow bearing insertion groove 1348*a*, 1348*b*, 1348*c*. And even if the vane spring 1342*a*, 1342*b*, 1342*c* is installed between the vane 1351, 1352, 1353 and the back pressure chamber 1347*a*, 1347*b*, 1347*c*, it may be difficult to obtain great elastic force due to a small width of the vane spring 1342*a*, 1342*b*, 1342*c*. Therefore, when the vane spring 1351, 1352, and 1353 is configured as the compression coil spring as in the previous embodiments, a greater effect may be obtained compared to the leaf spring.

Although not illustrated, the discharge port may be formed through the cylinder instead of the main bearing and the sub bearing. In this case as well, the basic configuration described above may be applied equally.

Embodiments disclosed herein provide a rotary compressor, capable of enhancing compressor efficiency by suppressing or preventing a delay of a start operation of the compressor. Embodiments disclosed herein further provide a rotary compressor capable of rapidly starting an initial operation by suppressing or preventing a refrigerant leakage near a contact point during an operation of the compressor. Embodiments disclosed herein furthermore provide a rotary compressor capable of further increasing compressor efficiency by reducing friction loss in other regions except for a region near a contact point while suppressing or preventing refrigerant leakage near the contact point during an operation of the compressor.

Embodiments disclosed herein provide a rotary compressor capable of reducing vibration noise due to trembling or shaking of vanes during an operation of the compressor. Embodiments disclosed herein further provide a rotary compressor capable of suppressing or preventing shaking or trembling of vanes by increasing a pressing force for a vane passing near a contact point toward a cylinder during an operation of the compressor. Embodiments disclosed herein furthermore provide a rotary compressor capable of suppressing or preventing uneven wear of a vane by applying a uniform pressing force to the vane passing near a contact point during an operation of the compressor.

Embodiments disclosed herein provide a rotary compressor capable of stabilizing a behavior of a vane inserted into a roller. Embodiments disclosed herein also provide a rotary compressor capable of stabilizing a behavior of a vane by reducing an affection of pressure pulsation on a rear surface of the vane.

Embodiments disclosed herein provide a rotary compressor capable of stabilizing a behavior of a vane, simplifying a structure for supporting the vane toward a cylinder, and obtaining a high vane bearing force at the same time. Embodiments disclosed herein also provide a rotary compressor capable of suppressing or preventing trembling of vanes even when a high-pressure refrigerant, such as R32, R410a, or $CO_2$ is used.

Embodiments disclosed herein provide a rotary compressor that may include a casing, a cylinder, a main bearing, a sub bearing, a rotational shaft, a roller, and at least one vane. The casing may have a hermetic inner space. The cylinder may be fixed to the inner space of the casing to define a compression space. The main bearing and the sub bearing may be respectively disposed on both sides of the cylinder in an axial direction. The rotational shaft may be inserted through the cylinder and supported by the main bearing and the sub bearing. The roller may be provided on the rotational shaft. An outer circumferential surface of the roller may be disposed to be eccentric with respect to the inner circumferential surface of the cylinder. The roller may also include at least one vane slot open to the outer circumferential surface. The vane may be slidably inserted into the vane slot, and a front surface of the vane may come in contact with the inner circumferential surface of the cylinder to partition the compression space into a plurality of compression chambers. The roller may include a roller body and a vane spring. The roller body may have a spring insertion groove formed in an inner end portion of the vane slot in a slot direction. The vane spring may be inserted into the spring insertion groove to support a rear surface of the vane toward the inner circumferential surface of the cylinder. With this configuration, an elastic force may be applied to the rear surface of the vane, so that the front surface of the vane in the vicinity of a contact point may be in close contact with the inner circumferential surface of the cylinder. Then, trembling of the vane that occurs in the vicinity of a proximal portion during operation of the compressor may be suppressed or prevented, thereby preventing leakage of refrigerant between the compression chambers. Accordingly, an initial start failure of the compressor may be suppressed or prevented, so that the compressor may start quickly. Also, a reverse flow of refrigerant from a discharge chamber to a suction chamber may be suppressed or prevented, so that suction loss may be greatly reduced. These all may result in improving compressor efficiency. In addition, when this is applied to a compressor provided in an air conditioner, cooling and heating effects may be quickly exhibited, thereby improving reliability and efficiency of the air conditioner.

For example, the vane spring may be configured as a compression coil spring. As the vane spring configured as the compression coil spring is installed on the rear surface of the vane, the vane spring may be easily installed and relatively high elastic force may be obtained.

For example, the vane spring may come in contact with the vane in a second section including a contact point where the outer circumferential surface of the roller closely approaches the inner circumferential surface of the cylinder, whereas the vane spring may be spaced apart from the vane in a first section out of the second section. Accordingly, the vane spring may stably stay in the spring insertion groove, and at the same time, the vane may be brought into contact with the vane spring only when the vane passes through the proximal portion including a discharge stroke (a part of a suction stroke or a part of a compression stroke may be included). This may suppress or prevent friction loss in the suction stroke and the compression stroke except for the proximal portion.

More specifically, the spring insertion groove may include a first spring fixing surface and a second spring fixing surface spaced apart from each other at a preset or predetermined distance along the slot direction of the vane slot, and both ends of the vane spring may be supported by the first spring fixing surface and the second spring fixing surface, respectively, in the first section. This may reduce friction loss which may occur while the vane passes through the suction stroke and the compression stroke.

For another example, a sealing distance between the spring insertion groove and an outer circumferential surface of the roller body may be greater than or equal to half of a lateral width of the vane slot. With this structure, the vane spring may be mounted by forming the spring insertion groove in the rear side of the vane and also leakage between compression chambers due to the spring insertion groove may be suppressed or prevented.

For another example, at least a portion of the spring insertion groove may overlap the vane slot in the axial direction. The vane may have a spring support portion formed at a position overlapping the spring insertion groove. With this structure, the vane spring that supports the rear side of the vane may be stably supported, while being spaced apart from the vane in a section out of a proximal portion, so as to suppress or prevent friction loss due to an excessive contact with the vane that may occur when the vane spring is applied.

For example, the spring support portion may be stepped by a preset or predetermined depth from one (first) axial side surface connected to the rear surface of the vane toward another axial (second) side surface. This may facilitate formation of the spring insertion groove in which the vane spring is mounted, and simultaneously allow oil of a discharge pressure or intermediate pressure to be smoothly guided toward the rear side of the vane such that the vane may be supported more stably.

The main bearing or the sub bearing may have a discharge port through which refrigerant of a compression chamber is discharged into the inner space of the casing. The spring support portion may be formed on an axial side surface facing a bearing having the discharge port. With this configuration, as the vane spring is disposed in a portion where pressure of a compression chamber is relatively high, reverse movement of the vane may be effectively suppressed or prevented, such that a surface pressure between the vane and the cylinder may be uniformly maintained in the axial direction. This may also prevent uneven wear of the vane, thereby enhancing efficiency of the compressor.

The spring support portion may be recessed by a preset or predetermined depth from a middle portion of the rear surface of the vane in the axial direction toward the front surface of the vane. Accordingly, one end of the vane spring may be stably supported so as to enhance efficiency and reliability of the compressor.

In addition, the spring support portion may include a first support surface and a second support surface. The first support surface may extend toward the front surface of the vane, and the second support surface may extend from the first support surface to an axial side surface of the vane so that an end portion of the vane spring may be supported in the slot direction. A length of the first support surface in the slot direction may be equal to or shorter than half of a length of the vane in the slot direction. This may allow the vane to be elastically supported by the vane spring only when the vane passes through the proximal portion and simultaneously secure a sealing distance when the vane passes through a remote portion, thereby suppressing or preventing an occurrence of leakage between compression chambers through the spring support portion. In addition, vibration noise caused by trembling of the vane during operation of the compressor may be reduced.

Further, an axial depth of the second support surface may be greater than or equal to an axial depth of the spring insertion groove. This may suppress or prevent friction between the vane and the vane spring, thereby stabilizing a behavior of the vane.

In another embodiment, the roller body may be formed as an integral body. The spring insertion groove may be recessed by a preset or predetermined axial depth from one (first) axial side surface to another (second) axial side surface of the roller body. This may facilitate formation of the roller having the spring insertion groove, thereby reducing manufacturing costs.

Also, a lateral width of the spring insertion groove may be greater than a lateral width of the vane slot. An outer diameter of the vane spring may be greater than the lateral width of the vane slot. With this structure, both ends of the vane spring inserted into the spring insertion groove may be stably fixed to the spring insertion groove.

The axial depth of the spring insertion groove may be greater than an outer diameter of the vane spring, and shorter than or equal to ½ of an axial height of the roller body. Accordingly, an axial open surface of the spring insertion groove may be covered by the main bearing (or sub bearing), so that the vane spring may be stably supported in the spring insertion groove.

The axial depth of the spring insertion groove may be greater than an outer diameter of the vane spring and greater than ½ of an axial height of the roller body. The vane spring may be disposed at an intermediate height of the roller body in the axial direction. As the vane spring supports the vane in the middle of the vane, a surface pressure between the vane and the cylinder may be uniformly maintained along the axial direction. This may also prevent uneven wear of the vane, thereby further enhancing efficiency of the compressor.

The rotary compressor may further include a cover member (cover) disposed on one side of the spring insertion groove in the axial direction to cover at least a portion of the spring insertion groove. This may suppress or prevent separation of the vane spring, thereby enhancing reliability.

In addition, an inner circumferential surface of the spring insertion groove and an outer circumferential surface of the cover member may be at least partially spaced apart from each other to define an oil passage. With this configuration, oil may be smoothly introduced into a rear side of the vane so as to more stably support the vane toward the cylinder.

For another example, the roller body may include a first roller body and a second roller body. The first roller body may define one (first) axial side surface. The second roller body may define another (second) axial side surface and coupled to one side of the first roller body in the axial direction. The spring insertion groove may be disposed between the first roller body and the second roller body. This may allow the vane spring of the vane to be installed easily and stably. This may also suppress or prevent uneven wear of the vane by uniformly applying pressing force to the vane passing near a contact point during operation of the compressor.

In addition, the spring insertion groove may include a first spring insertion groove and a second spring insertion groove. The first spring insertion groove may be formed in the first roller body, and the second spring insertion groove may be formed in the second roller body. The first spring insertion groove and the second spring insertion groove may be symmetrical to each other with respect to surfaces of the first roller body and the second roller body that face each other. This may facilitate manufacturing of a separable roller body, thereby reducing manufacturing costs.

More specifically, the first roller body may include a first vane slot and a first spring insertion groove, and the second roller body may include a second vane slot and a second spring insertion groove. The first vane slot and the second vane slot may be formed on a same axis with each other, and the first spring insertion groove and the second spring insertion groove may be formed on the same axis with each other. The first spring insertion groove may be formed such that at least a portion thereof overlaps the first vane slot in the axial direction, and may be recessed by a preset or predetermined depth from one (first) axial side surface of the first roller body toward another (second) axial side surface of the first roller body. The second spring insertion groove may be formed such that at least a portion thereof overlaps the second vane slot in the axial direction, and may be recessed by a preset or predetermined depth from one (first) axial side surface of the second roller body facing the one axial side surface of the first roller body toward another (second) axial side surface of the second roller body.

More specifically, the first roller body and the second roller body may have a same axial height, and the first spring insertion groove and the second spring insertion groove may have a same depth. This may facilitate manufacturing of a separable roller body and stably support the vane spring.

For another example, a shaft hole may be formed in a center of the roller, and the rotational shaft may be inserted into the shaft hole of the roller. Accordingly, the roller in which the vane spring is inserted may be easily manufactured. In addition, the roller may be made of a material different from the rotational shaft. This may facilitate processing of the roller in which the vane spring is inserted and simultaneously reduce a weight of a rotating body including the roller.

A rotation preventing groove may be formed in an inner circumferential surface of the shaft hole and a rotation preventing key may be formed on an outer circumferential surface of the rotational shaft and inserted into the rotation preventing groove to be restricted in a circumferential direction. This may prevent idling of the roller or rotational shaft, so as to allow stable coupling between the roller and the rotational shaft.

For another example, the roller may integrally extend from an outer circumferential surface of the rotational shaft. Accordingly, an assembly operation of the rotational shaft including the roller may be excluded and simultaneously a rotational force of the rotational shaft may be stably transferred to the roller.

For another example, the vane slot may be inclined by a preset or predetermined angle with respect to a radial direction of the roller. Accordingly, the vane spring may be stably installed in one side of the vane slot while securing a length of the vane slot.

For still another example, the vane slot may be formed in a radial direction of the roller. Accordingly, the vane slot may be easily formed and also the vane may be stably supported using the vane spring.

For still another example, a plurality of back pressure pockets each having a different pressure may be formed to be spaced apart from each other in a circumferential direction in at least one of a sliding surface of the main bearing facing one (first) axial side surface of the roller or a sliding surface of the sub bearing facing another (second) axial side surface of the roller. Each of the plurality of back pressure pockets may be formed to overlap the spring insertion groove in the axial direction. With this configuration, the vane spring may be disposed at the rear side of the vane and oil of a back pressure pocket may be smoothly supported toward the rear side of the vane through the spring insertion groove, which may effectively suppress or prevent trembling of the vane even in the vicinity of the contact point.

For another example, a sliding surface of the main bearing facing one axial side surface of the roller and a sliding surface of the sub bearing facing another axial side surface of the roller may be formed to be flat in a direction overlapping the spring insertion groove. With this configuration, as the back pressure pockets are excluded from the main bearing and the sub bearing, processing of the main bearing and the sub bearing may be facilitated, and also bearing surfaces supporting the rotational shaft may be formed in a circular shape, thereby further stably supporting the rotational shaft in the radial direction.

For example, the vane spring may be configured as a compression coil spring, and the vane spring may have one (first) end supported by the spring insertion groove and another (second) end supported by the rear surface of the vane. Accordingly, the vane spring may continuously elastically support the vane, which may result in excluding back pressure pockets from the main bearing and sub bearing.

In the rotary compressor according to embodiments disclosed herein, the inner circumferential surface of the cylinder may be formed in an elliptical shape. Also, in the rotary compressor according to embodiments disclosed herein, the inner circumferential surface of the cylinder may be formed in a circular shape.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vane rotary compressor, comprising:

a casing;

a cylinder fixed to an inner space of the casing to define a compression space;

a main bearing and a sub bearing disposed, respectively, on both sides of the cylinder in an axial direction;

a rotational shaft inserted through the cylinder to be supported on the main bearing and the sub bearing;

a roller disposed on the rotational shaft, having an outer circumferential surface that is eccentric with respect to an inner circumferential surface of the cylinder, and provided with at least one vane slot open toward the outer circumferential surface; and a vane slidably inserted into the at least one vane slot, a front surface of the vane coming in contact with the inner circumferential surface of the cylinder to partition the compression space into a plurality of compression chambers, wherein the roller comprises:

a roller body having at least one spring insertion groove formed at an inner end portion of the at least one vane slot in a lengthwise direction of the at least one vane slot; and a vane spring inserted into the at least one spring insertion groove to support a rear surface of the at least one vane toward the inner circumferential surface of the cylinder, wherein at least a portion of the at least one spring insertion groove overlaps the at least one vane slot in the axial direction, wherein the at least one vane comprises a spring support portion formed at a position overlapping the at least one spring insertion groove, and wherein the spring support portion is stepped by a predetermined depth from a first axial side surface connected to a rear surface of the vane toward a second axial side surface.

2. The vane rotary compressor of claim 1, wherein the vane spring comprises a compression coil spring, and wherein the vane spring is brought into contact with the vane in a second section including a contact point at which the outer circumferential surface of the roller closely approaches the inner circumferential surface of the cylinder, and spaced apart from the vane in a first section out of the second section.

3. The vane rotary compressor of claim 2, wherein the at least one spring insertion groove comprises a first spring fixing surface and a second spring fixing surface which are spaced apart from each other by a predetermined distance along the lengthwise direction of the at least one vane slot, and wherein first and second ends of the vane spring are, respectively, supported by the first spring fixing surface and the second spring fixing surface in the first section.

4. The vane rotary compressor of claim 1, wherein a sealing distance between the at least one spring insertion groove and the outer circumferential surface of the roller body is greater than or equal to half of a lateral width of the at least one vane slot.

5. The vane rotary compressor of claimer 1, wherein the main bearing or the sub bearing includes a discharge port through which refrigerant of a compression chamber is discharged into the inner space of the casing, and wherein the spring support portion is formed on an axial side surface facing the bearing having the discharge port.

6. The vane rotary compressor of claim 1, wherein the spring support portion is recessed by a predetermined depth from a middle portion of the rear surface of the vane in the axial direction toward the front surface of the vane.

7. The vane rotary compressor of claim 1, wherein the spring support portion comprises:

a first support surface that extends toward a front surface of the vane; and a second support surface that extends from the first support surface to an axial side surface of the vane so that an end portion of the vane spring is supported in the lengthwise direction of the at least one vane slot, wherein a length of the first support surface in the lengthwise direction of the at least one vane slot is equal to or shorter than half of a length of the vane in the lengthwise direction of the at least one vane slot, and wherein an axial depth of the second support surface is greater than or equal to an axial depth of the at least one spring insertion groove.

8. The vane rotary compressor of claim 1, wherein the roller body is formed as an integral body, and wherein the at least one spring insertion groove is recessed by a predetermined axial depth from a first axial side surface to a second axial side surface of the roller body.

9. The vane rotary compressor of claim 8, wherein a lateral width of the at least one spring insertion groove is greater than a lateral width of the at least one vane slot, and wherein an outer diameter of the vane spring is greater than the lateral width of the at least one vane slot.

10. The rotary compressor of claim 8, wherein an axial depth of the at least one spring insertion groove is greater than an outer diameter of the vane spring, and shorter than or equal to ½ of an axial height of the roller body.

11. The vane rotary compressor of claim 8, wherein an axial depth of the at least one spring insertion groove is greater than an outer diameter of the vane spring, and greater than ½ of an axial height of the roller body, and wherein the vane spring is disposed at an intermediate height of the roller body in the axial direction.

12. The vane rotary compressor of claim 11, further comprising a cover disposed on one side of the at least one spring insertion groove in the axial direction to cover at least a portion of the at least one spring insertion groove.

13. The vane rotary compressor of claim 12, wherein an inner circumferential surface of the at least one spring insertion groove and an outer circumferential surface of the cover are at least partially spaced apart from each other to define an oil passage.

14. The vane rotary compressor of claim 1, wherein the roller body comprises:

a first roller body defining a first axial side surface; and a second roller body defining a second axial side surface and coupled to one side of the first roller body in the axial direction, and wherein the at least one spring insertion groove comprises a first spring insertion groove formed in the first roller body and a second spring insertion groove formed in the second roller body.

15. The vane rotary compressor of claim 14, wherein the at least one spring insertion groove comprises a first spring insertion groove formed in the first roller body and a second spring insertion groove formed in the second roller body, wherein the first roller body comprises a first vane slot and the second roller body comprises a second vane slot, wherein the first vane slot and the second vane slot are formed on a same axis with each other, and a first spring insertion groove and the second spring insertion groove are formed on the same axis with each other, wherein the first spring insertion groove is formed such that at least a portion thereof overlaps the first vane slot in the axial direction, and is recessed by a predetermined depth from a first axial side surface of the first roller body toward a second axial side surface of the first roller body, and wherein the second spring insertion groove is formed such that at least a portion thereof overlaps the second vane slot in the axial direction, and is recessed by a predetermined depth from a first axial side surface of the second roller body facing the first axial side surface of the first roller body toward a second axial side surface of the second roller body.

16. The vane rotary compressor of claim 15, wherein the first roller body and the second roller body have a same axial height, and wherein the first spring insertion groove and the second spring insertion groove have a same depth.

17. The vane rotary compressor of claim 1, wherein a shaft hole is formed in a center of the roller, wherein the rotational shaft is inserted into the shaft hole of the roller, and wherein a rotation preventing groove is formed in an inner circumferential surface of the shaft hole and a rotation preventing key is formed on an outer circumferential surface of the rotational shaft and inserted into the rotation preventing groove to be restricted in a circumferential direction.

18. The vane rotary compressor of claim 1, wherein a plurality of back pressure pockets each having a different pressure are spaced apart from each other in a circumferential direction in at least one of a sliding surface of the main bearing facing a first axial side surface of the roller or a sliding surface of the sub bearing facing a second axial side surface of the roller, and wherein each of the plurality of back pressure pockets is formed to overlap the at least one spring insertion groove in the axial direction.

19. The vane rotary compressor of claim 1, wherein a sliding surface of the main bearing facing a first axial side surface of the roller and a sliding surface of the sub bearing facing a second axial side surface of the roller are formed to be flat in a direction overlapping the at least one spring insertion groove, wherein the vane spring comprises a compression coil spring, and wherein the vane spring has a first end supported by the at least one spring insertion groove and a second end supported by a rear surface of the vane.

20. A vane rotary compressor, comprising:

a casing;

a cylinder fixed to an inner space of the casing to define a compression space;

a main bearing and a sub bearing disposed, respectively, on both sides of the cylinder in an axial direction;

a rotational shaft inserted through the cylinder to be supported on the main bearing and the sub bearing;

a roller disposed on the rotational shaft, having an outer circumferential surface that is eccentric with respect to an inner circumferential surface of the cylinder, and provided with at least one vane slot open toward the outer circumferential surface; and a vane slidably inserted into the at least one vane slot, a front surface of the vane coming in contact with the inner circumferential surface of the cylinder to partition the compression space into a plurality of compression chambers, wherein the roller comprises:

a roller body having at least one spring insertion groove formed at an inner end portion of the at least one vane slot in a lengthwise direction of the at least one vane slot; and a vane spring inserted into the at least one spring insertion groove to support a rear surface of the at least one vane toward the inner circumferential surface of the cylinder, wherein the roller body comprises:

a first roller body defining a first axial side surface; and a second roller body defining a second axial side surface and coupled to one side of the first roller body in the axial direction, and wherein the at least one spring insertion groove comprises a first spring insertion groove formed in the first roller body and a second spring insertion groove formed in the second roller body.

* * * * *